US006533543B2

(12) United States Patent
Tagomori et al.

(10) Patent No.: US 6,533,543 B2
(45) Date of Patent: Mar. 18, 2003

(54) VORTEX PREVENTION APPARATUS IN PUMP

(75) Inventors: Masashi Tagomori, Tokyo (JP); Takashi Enomoto, Tokyo (JP); Tsuyoshi Tomita, Tokyo (JP); Hiroyuki Kato, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/774,004

(22) Filed: Jan. 31, 2001

(65) Prior Publication Data

US 2001/0018023 A1 Aug. 30, 2001

(30) Foreign Application Priority Data

| | | |
|---|---|---|
| Feb. 2, 2000 | (JP) | 2000-025406 |
| Jun. 23, 2000 | (JP) | 2000-189950 |
| Sep. 11, 2000 | (JP) | 2000-275465 |

(51) Int. Cl.[7] ..... F03B 15/06

(52) U.S. Cl. ..... 415/159; 415/151; 415/191; 415/208.2

(58) Field of Search ..... 415/151, 157, 415/159, 191, 208.2

(56) References Cited

U.S. PATENT DOCUMENTS 5,024,729 A * 6/1991 Kuhasalo et al. ..... 162/372

FOREIGN PATENT DOCUMENTS

| | | | | |
|---|---|---|---|---|
| GB | 785926 | * | 11/1957 | |
| JP | 51-26324 | | 7/1976 | |
| JP | 53-148001 | | 12/1978 | |
| JP | 54-7601 | | 1/1979 | |
| JP | 54007601 | * | 1/1979 | ..... F04B/23/02 |
| JP | 54-152202 | | 11/1979 | |
| JP | 1017198 | | 3/1980 | |
| JP | 57-198379 | | 12/1982 | |
| JP | 405172079 A | * | 7/1993 | ..... F04D/13/00 |
| JP | 8-68396 | | 3/1996 | |
| JP | 08068396 | * | 3/1996 | ..... F04D/29/44 |
| JP | 1999-578325 | * | 9/1999 | ..... F04D/13/16 |
| JP | 2000018199 A | * | 1/2000 | ..... F04D/0/29 |

* cited by examiner

*Primary Examiner*—Edward K. Look
*Assistant Examiner*—Igor Kershteyn
(74) *Attorney, Agent, or Firm*—Armstrong Westerman & Hattori, LLP

(57) ABSTRACT

A vortex prevention apparatus is combined with a pump, and prevents an air entrained vortex or a submerged vortex from being produced when water in the pump pit is pumped up by a pump. A suction member is disposed in an open water channel and has a suction port. An auxiliary flow-path forming structure is disposed substantially concentrically around the suction member with a gap defined between the auxiliary flow-path forming structure and an outer circumferential surface of the suction member.

30 Claims, 33 Drawing Sheets

VORTEX PREVENTION APPARATUS IN PUMP

BACKGROUND OF THE INVENTION

1. Field of the Invention

The present invention relates to a pump such as a circulating water pump for use in water supply and discharge facilities and power plants, and more particularly to a vortex prevention apparatus for use in a pump pit for preventing an air entrained vortex or a submerged vortex from being produced when water in the pump pit is pumped by a pump.

2. Description of the Related Art

For pumping water from an open channel that is generally used, as shown in FIGS. 31A and 31B of the accompanying drawings, it has been customary to install a pump in such a manner that a suction port 14*a* defined in the lower end of a suction bell mouth 14 connected to the lower end of a suction casing (pump casing) 12 is immersed in water in a pump pit 10. When the pump is operated, water in the pump pit 10 is introduced through the suction port 14*a* into the suction casing 12. In this case, since water around the suction port 14*a* has a free surface, if the suction port 14*a* is immersed by a small depth S or water in the open channel flows at a large velocity V, then an air entrained vortex (air entraining vortex) A which is connected from the water surface to the suction port 14*a* by a vortex filament L may be generated, or a submerged vortex B which is connected from the bottom of the pump pit 10 to the suction port 14*a* may be generated. The generation of the air entrained vortex A or the submerged vortex B tends to cause vibration and noise which are detrimental to the operation of the pump.

As shown in FIGS. 32A and 32B of the accompanying drawings, a water discharge pump is combined with a lateral-suction closed-type channel and has a suction casing 12 having a suction bell mouth 14 placed in a closed-conduit pump pit 10 which has a laterally open inlet port 10*c*. Since water around the suction port 14*a* of the suction bell mouth 14 connected to the lower end of the suction casing 12 has no free surface, generation of an air entrained vortex is suppressed. However, when water in the channel flows at an increased velocity V, an air entrained vortex A which is connected from the free surface in an open channel to the suction port 14*a* by a vortex filament L may be generated, and the construction cost of the closed-type channel is high.

FIGS. 33A and 33B of the accompanying drawings show still another conventional pump having a suction casing 12 placed in a pump pit 10. A vortex prevention plate 16 having a semicircular recess 16*a* surrounding the suction casing 12 is horizontally attached to a peripheral wall 10*a* of the pump pit 10. An L-shaped vortex prevention plate (splitter) 18 is attached to the peripheral wall 10*a* and a bottom wall 10*b* of the pump pit 10. The L-shaped vortex prevention plate 18 extends along the direction of the water flow from a position laterally of the suction casing 12 to a position below a suction bell mouth 14 connected to the lower end of the suction casing 12.

FIGS. 34A, 34B, and 35 of the accompanying drawings show yet another vortex prevention structure including an annular frame 152 mounted concentrically on the lower end of a suction pipe 150 by support rods 154. The annular frame 152 has a diameter greater than the diameter of the suction pipe 150. The annular frame 152 extends across water flows 156 in a water channel which are directed toward a suction port 150*a* defined in the lower end of the suction pipe 150, for thereby producing a turbulent layer 158 which extends from the frame 152 to the suction port 150*a* to prevent an air entrained vortex from being produced.

FIGS. 36A and 36B of the accompanying drawings show still another vortex prevention structure. The vortex prevention structure comprises an inlet water channel casing 160 in the form of a rectangular box having a laterally open inlet port 160*a* and an upwardly open connection port 160*b* and defining a closed water channel 162 therein. The inlet water channel casing 160 is placed in an open-type pump pit 10 in such a manner that the inlet port 160*a* is directed upstream, and the connection port 160*b* is joined to the suction port 14*a* of the suction bell mouth 14.

With the conventional arrangement shown in FIGS. 33A and 33B, it is necessary to attach the vortex prevention plate 16 and the splitter 18 to the peripheral wall 10*a* and the bottom wall 10*b* of the pump pit 10 and install them in the pump pit 10. Therefore, a civil engineering work is needed to install the vortex prevention plate 16 and the splitter 18, and hence the construction cost of the arrangement shown in FIGS. 33A and 33B is very high. Furthermore, it is very difficult to add the vortex prevention plate 16 and the splitter 18 to the peripheral wall and the bottom wall of an existing pump pit.

With the conventional structure shown in FIGS. 34A, 34B and 35, if a vortex filament extending from the water surface where an air entrained vortex is formed to the suction port passes through a portion near the inside of the frame 152, like a vortex filament 2A, the vortex filament 2A is disturbed by a turbulent layer 158 of wake flow produced by the frame 152, and hence the air entrained vortex becomes unstable and tends to collapse. However, since the air entrained vortex is produced so as to avoid the frame 152 as an obstacle, a vortex filament 1A extending from a portion near the suction pipe 150 to the suction port 150*a* and a vortex filament 3A extending from a portion outside of the frame 152 to the suction port 150*a* are mostly produced at positions away from the frame 152. Therefore, the vortex filaments 1A, 3A are hardly affected by the turbulent layer 158, and hence the vortex prevention capability is presumably small.

The conventional structure shown in FIGS. 36A and 36B can suppress the generation of air entrained vortexes at the free surface to a certain extent because the distance from the suction port 14*a* to the free surface is long and the velocity of water flowing through the inlet port 160*a* is considerably lower than the velocity of water flowing through the suction port 14*a*. If the velocity V of water in the channel increases, then there arises an air entrained vortex A which has a vortex filament L extending from the free surface to the suction port 14*a* through the inlet port 160*a* and the closed water channel 162.

SUMMARY OF THE INVENTION

It is therefore an object of the present invention to provide a vortex prevention apparatus which is capable of preventing air entrained vortexes from being generated in a pump pit with a relatively simple arrangement, without requiring a civil engineering work.

Another object of the present invention is to provide a vortex prevention apparatus which is capable of preventing air entrained vortexes from being generated in a pump pit with a relatively simple arrangement, even if water flows in a water channel at an increased velocity.

According to an aspect of the present invention, there is provided a vortex prevention apparatus comprising: a suction member disposed in an open water channel and having a suction port; and an auxiliary flow-path forming structure disposed substantially concentrically around the suction member with a gap defined between the auxiliary flow-path forming structure and an outer circumferential surface of the suction member, the auxiliary flow-path forming structure defining an auxiliary flow path.

With the above arrangement, a water flow directed from a water surface side toward the suction port is divided into a main flow and an auxiliary flow along the auxiliary flow path, so that locally intense downward flows which is a cause of an air entrained vortex will not be produced. A vortex prevention capability is achieved simply by placing the auxiliary flow-path forming structure or member around the suction member. Therefore, it is not necessary to perform a civil construction work to attach a vortex prevention structure in a pump pit. Therefore, the pump pit may be of a simple rectangular reservoir structure, and hence can be constructed at a low cost.

The auxiliary flow-path forming structure is disposed substantially horizontally over the suction port and spaced therefrom by a predetermined distance.

The auxiliary flow-path forming structure is mounted on the suction member by a plurality of ribs disposed at spaced intervals in a circumferential direction of the auxiliary flow-path forming structure. The ribs are effective in circumferentially dispersing flows which are directed from a portion near the water surface toward the suction port and are a cause of air entrained vortexes. The ribs can provide an increased vortex prevention capability.

The auxiliary flow-path forming structure comprises a plurality of divided members disposed in surrounding relation to a substantially entire circumferential surface of the suction member or a given position of the suction member.

The divided members are radially movably supported on the suction member. For giving a vortex prevention capability to an existing pump, the auxiliary flow-path forming structure is contracted radially inwardly and inserted into a pump installation opening. Then, the auxiliary flow-path forming structure is spread radially outwardly. Therefore, the auxiliary flow-path forming structure which is of a diameter larger than the dimension of the pump installation opening is disposed around the suction member.

The auxiliary flow-path forming structure comprises a ring-shaped pipe.

The pump vortex prevention apparatus further comprises a swirling flow prevention plate mounted on at least one of upper and lower surfaces of the auxiliary flow-path forming structure, and extending vertically and linearly along a water flow. Even when a swirling flow which is a cause of generating a vortex is produced around a pump, the swirling flow is suppressed by the swirling flow prevention plate, thus preventing air entrained vortexes and submerged vortexes from being produced.

The auxiliary flow-path forming structure is of a substantially cylindrical shape disposed around the suction member and spaced therefrom by a predetermined distance.

The pump vortex prevention apparatus further comprises a disk-shaped auxiliary top plate having a hole and disposed above the auxiliary flow-path forming structure with a gap defined between the disk-shaped auxiliary top plate and the auxiliary flow-path forming structure. The disk-shaped auxiliary top plate is effective to prevent a surface vortex from being produced at a position immediately above an inlet of the auxiliary flow path, thus causing a vortex passing through the auxiliary flow path to collapse.

The pump vortex prevention apparatus further comprises a second auxiliary flow-path forming structure disposed concentrically around the auxiliary flow-path forming structure with a gap defined between the second auxiliary flow-path forming structure and the auxiliary flow-path forming structure, the second auxiliary flow-path forming structure defining a second auxiliary flow path.

The auxiliary flow-path forming structure has a wing-like cross-sectional shape for developing a velocity difference between flows along opposite surfaces thereof. The wing-like cross-sectional shape prevents foreign matter from being attached to an upper edge of the auxiliary flow-path forming structure.

The auxiliary flow-path forming structure is mounted on the suction member by a plurality of ribs disposed at spaced intervals in a circumferential direction of the auxiliary flow-path forming structure.

Each of the ribs has an arcuate transverse cross-sectional shape extending in one direction. The arcuate transverse cross-sectional shape of the rib imparts a circumferential pre-swirling flow along the rib to prevent a submerged vortex from being produced.

The vortex prevention apparatus further comprises a bent guide integrally joined to a lower end of the auxiliary flow-path forming structure, the bent guide being curved toward the suction port. The bent guide guides an auxiliary flow to be introduced smoothly into the suction port, resulting in a reduced inlet loss at the suction port.

The vortex prevention apparatus further comprises a pump mount base having a plurality of vertically extending flow-rectifying ribs, the auxiliary flow-path forming structure being disposed between the vertically extending flow-rectifying ribs. Whereas the auxiliary flow-path forming structure prevents an air entrained vortex from being produced, the flow-rectifying ribs which serve to rectify water flows suppress a swirling flow around the pump.

The pump vortex prevention apparatus further comprises a disk-shaped inflow amount adjusting plate having a hole and mounted on an upper end of the auxiliary flow-path forming structure. Since the amount of water flowing into the auxiliary flow path is adjusted by the disk-shaped inflow amount adjusting plate, a large amount of water is prevented from flowing into the auxiliary flow path, and hence an air entrained vortex is prevented from being produced in the auxiliary flow path.

The auxiliary flow-path forming structure comprises a plurality of divided members disposed in surrounding relation to a substantially entire circumferential surface of the suction member or a given position of the suction member.

The divided members are radially movably supported on the suction member.

According to another aspect of the present invention, there is also provided a pump vortex prevention apparatus comprising: a suction member disposed in an open water channel and having a suction port; an auxiliary flow-path forming structure disposed substantially concentrically around the suction member with a gap defined between the auxiliary flow-path forming structure and an outer circumferential surface of the suction member, the auxiliary flow-path forming structure defining an auxiliary flow path; and a suction cone disposed below the suction port. Whereas the auxiliary flow-path forming structure prevents an air entrained vortex from being produced, the suction cone prevents a submerged vortex from being produced.

According to still another aspect of the present invention, there is also provided a pump vortex prevention apparatus comprising: a suction member disposed in an open water channel and having a suction port, the suction member having at least one through hole; and an auxiliary flow-path forming structure disposed substantially concentrically around the suction member, the auxiliary flow-path forming structure being fixedly mounted on a free end of the suction member. The through hole defines an auxiliary flow path. Since no ribs are required to fix the auxiliary flow-path forming structure, the pump vortex prevention structure is simplified in structure.

According to yet another aspect of the present invention, there is also provided a pump vortex prevention apparatus comprising: an inflow water channel structure defining a closed inflow water channel having a laterally open inlet port; and a flow-rectifying plate disposed above the inflow water channel structure and extending upstream of the inlet port in covering relation to the inlet port, the flow-rectifying plate being disposed substantially horizontally and spaced by a predetermined distance from an upper end of the closed inflow water channel structure.

With the above arrangement, shear flows having different velocities across the flow-rectifying plate are produced, and a water flow flowing between the flow-rectifying plate and the inflow water channel structure cuts off a vortex filament interconnecting the free water surface and the inlet port. Therefore, an air entrained vortex is prevented from being produced in the pump pit.

The flow-rectifying plate is inclined to a horizontal plane by an angle in the range of ±30° for thereby adjusting the water flow flowing between the flow-rectifying plate and the inflow water channel structure and cutting off a vortex filament interconnecting the free water surface and the inlet port.

The flow-rectifying plate has a front edge progressively inclined along a water flow toward opposite ends thereof. Therefore, any foreign matter such as strings attached to the inclined front edge can easily be removed.

The vortex prevention apparatus further comprises a plurality of vertical plates disposed between the inflow water channel structure and the flow-rectifying plate and extending substantially vertically along a water flow, at least one of the vertical plates extending above the flow-rectifying plate. By pre-assembling the vertical plates, the flow-rectifying plate, and also the inflow water channel structure at the factory, the flow-rectifying plate can easily be installed in position. The vertical plate extending above the flow-rectifying plate makes it difficult for a swirling flow to be produced around the pump and above the inflow water channel structure.

Each of the vertical plates is inclined to a vertical plane along the water flow by an angle in the range of ±30° for thereby adjusting the water flow flowing between the flow-rectifying plate and the inflow water channel structure and cutting off a vortex filament interconnecting the free water surface and the inlet port.

Each of the vertical plates has a front edge progressively inclined downwardly along the water flow. Therefore, any foreign matter attached to the inclined front edge can easily be removed.

The vortex prevention apparatus further comprises a swirling flow prevention plate extending vertically and disposed between a rear end of the inflow water channel structure and a rear wall of the closed inflow water channel. The swirling flow prevention plate makes it difficult for a swirling flow to be produced around the pump, even if the gap between the rear end of the inflow water channel structure and the rear wall of the water channel is large.

The closed inflow water channel structure is detachably connected to a pump suction port.

The inflow water channel structure comprises an elbow-type suction casing. With this arrangement, no water discharge pump needs to be installed on the bottom of the pump pit, and no vortex prevention structure is required to be installed in the pump pit.

The vortex prevention apparatus further comprises a vertical partition wall for partitioning a pump pit, and the inflow water channel structure comprises a horizontal partition wall extending substantially horizontally to an upstream side and joined to a lower end of the vertical partition wall.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1A:
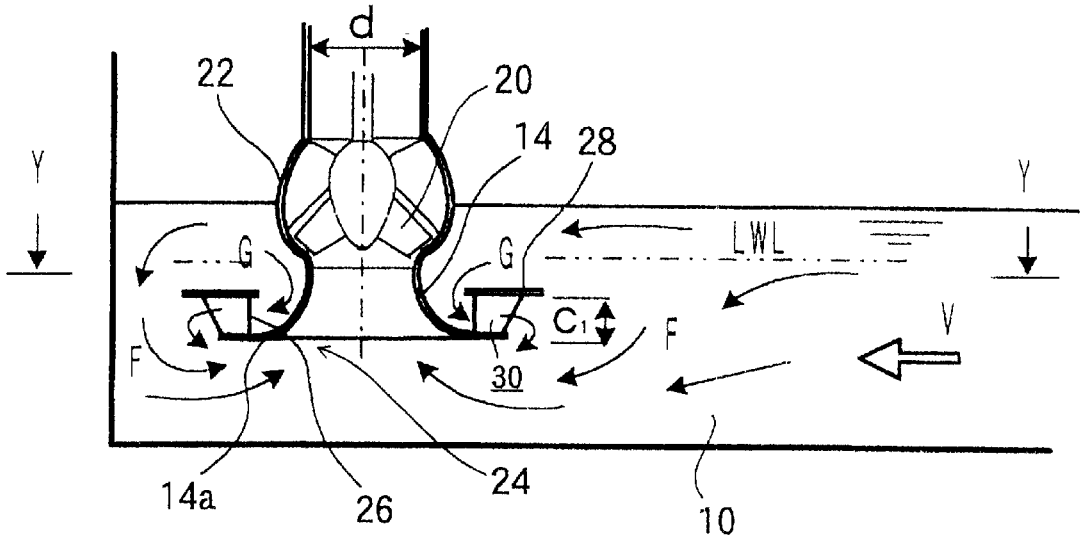
FIG. 1A is a cross-sectional view showing a vortex prevention apparatus in a pump according to a first embodiment of the present invention.
Figure 1B:
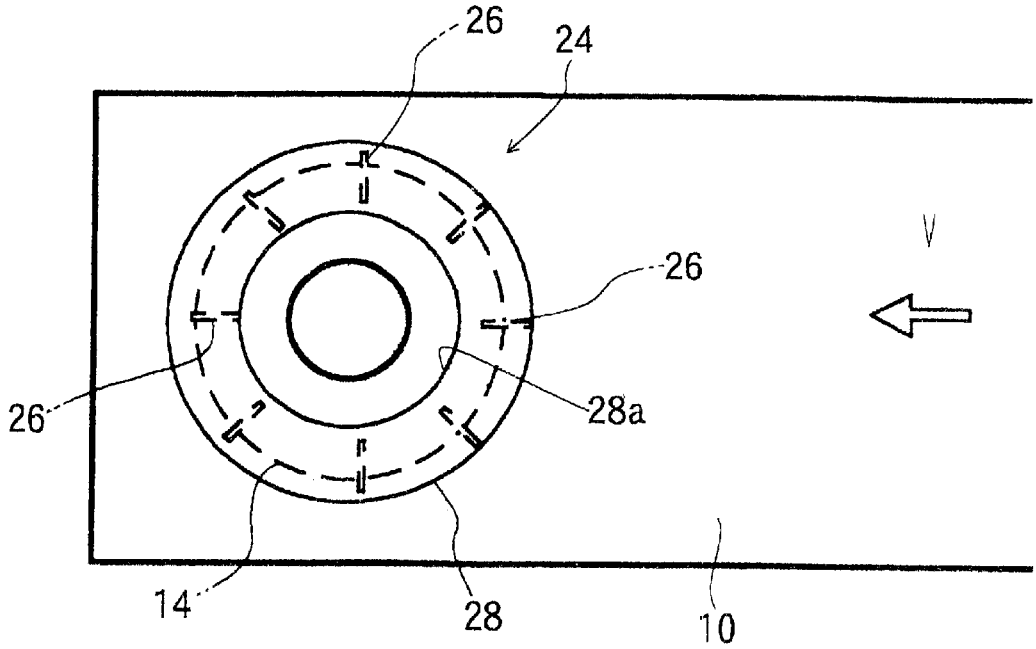
FIG. 1B is a cross-sectional view taken along line Y—Y of FIG. 1A.
Figure 2:
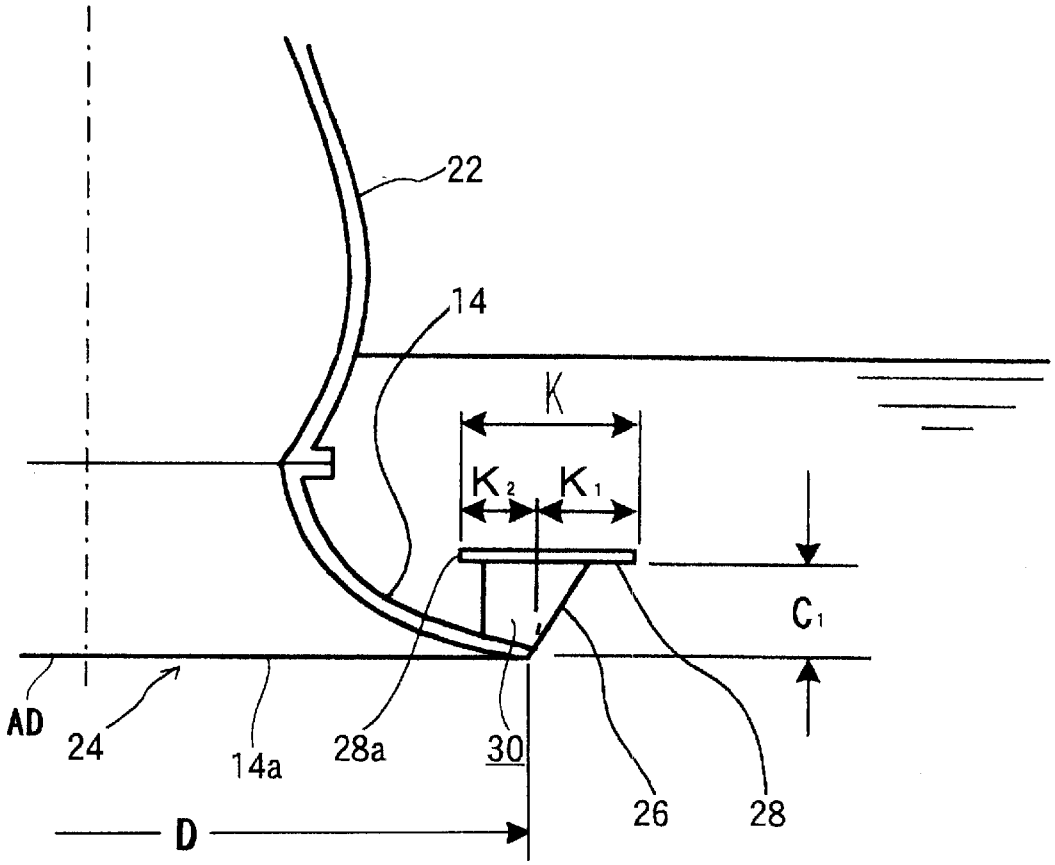
FIG. 2 is an enlarged cross-sectional view showing a portion of the vortex prevention apparatus shown in FIG. 1A.

FIGS. 1A, 1B, and 2 show a vortex prevention apparatus in a pump according to a first embodiment of the present invention. The vortex prevention apparatus is combined with a pump having a discharge bowl (pump casing) 22 with an impeller 20 disposed therein, and a suction bell mouth structure 24 connected to the lower end of the discharge bowl 22.

The suction bell mouth structure 24 comprises a suction bell mouth (suction member) 14, and a disk-shaped auxiliary flow-path forming plate (auxiliary flow-path forming member or structure) 28 having a central hole 28*a* and mounted on an outer circumferential surface of the suction bell mouth 14 by a plurality of ribs 26 spaced at a given pitch in the circumferential direction. The auxiliary flow-path forming plate 28 is disposed substantially horizontally.

The auxiliary flow-path forming plate 28 is positioned over a suction port 14*a* defined in the suction bell mouth 14, i.e., is positioned such that the suction bell mouth 14 has a barrel disposed in the hole 28*a* of the auxiliary flow-path forming plate 28, with a gap defined between the plane of the suction port 14*a* and the lower surface of the auxiliary flow-path forming plate 28. The auxiliary flow-path forming plate 28 is also positioned below the lowest low-water level LWL. An auxiliary flow path 30 is thus defined between the suction bell mouth 14 and the auxiliary flow-path forming plate 28. The gap of the auxiliary flow path 30 has such a dimension $C_1$ at a position of a suction bell mouth diameter D that an opening area $\pi D \cdot C_1$ produced by the dimension is in the range of 20 to 70% of an area $\pi D^2/4$ of a pump suction port AD at the suction bell mouth diameter D.

As the width K of the auxiliary flow-path forming plate 28 is larger, the vortex prevention capability is increased. The vortex prevention capability of the auxiliary flow-path forming plate 28 is remarkably presented if the width K is in the range of 0.2 to 0.3 or more of the suction bell mouth diameter D. As shown in FIG. 2, the auxiliary flow-path forming plate 28 has such a size that it has a radially outward extension $K_1$ beyond the outer circumferential edge of the suction bell mouth 14. The auxiliary flow-path forming plate 28 includes a portion $K_2$ positioned radially inwardly of the radially outward extension $K_1$. However, the portion $K_2$ may not necessarily be required.

The ribs 26 have an effect for dispersing a flow, in a circumferential direction, which is directed from a portion near the water surface toward the suction port 14*a* and is a cause of air entrained vortexes. As the number of the ribs 26 increases, the vortex prevention capability is increased because intense downward flows are hard to be generated in local areas. Thus, it is preferable to provide about eight or slightly more ribs as shown in FIG. 1B.

When the pump installed in a pump pit 10 is operated to pump water from the pump pit 10, a water flow directed from the water surface side toward the suction port 14*a* is divided into a main flow F, and an auxiliary flow G along the auxiliary path 30 defined between the suction bell mouth 14 and the auxiliary flow-path forming plate 28. Thus, locally intense downward flows are not formed, and hence air entrained vortexes are prevented from being produced. As described above, because the ribs 26 on which the auxiliary flow-path forming plate 28 is mounted are effective in dispersing a flow, in a circumferential direction, which is directed from a portion near the water surface toward the suction port 14*a* and is a cause of air entrained vortexes, the ribs 26 make it difficult to produce locally intense downward flows and hence effectively assist in preventing air entrained vortexes from being produced.

Inasmuch as vortexes are prevented from being produced by the suction bell mouth structure 24 that is connected to the lower end of the discharge bowl 22, no construction work is required to attach a vortex prevention structure in the pump pit 10. Therefore, the pump pit 10 may be of a simple rectangular reservoir structure, and hence can be constructed at a low cost.

Figure 3:
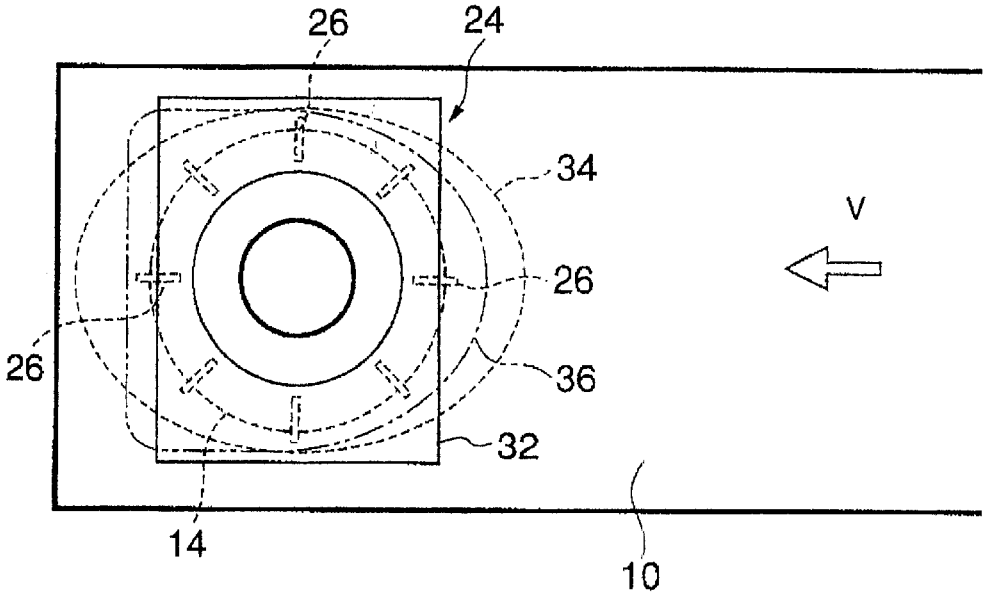
FIG. 3 is a view similar to FIG. 1B, showing a modification of the vortex prevention apparatus according to the first embodiment of the present invention.

Although the disk-shaped auxiliary flow-path forming plate 28 is used as the auxiliary flow-path forming member or structure in this embodiment, a rectangular auxiliary flow-path forming plate 32 having a central hole as indicated by the solid lines in FIG. 3 or a polygonal auxiliary flow-path forming plate may be used as the auxiliary flow-path forming member or structure. Alternatively, an elliptical auxiliary flow-path forming plate 34 having a central hole as indicated by the broken lines in FIG. 3, or an auxiliary flow-path forming plate 36 having a central hole and a desired configration, e.g., a circular upstream portion and a rectangular downstream portion, as indicated by the two-dot-and-dash lines in FIG. 3, may be used as the auxiliary flow-path forming member or structure.

Figure 4A:
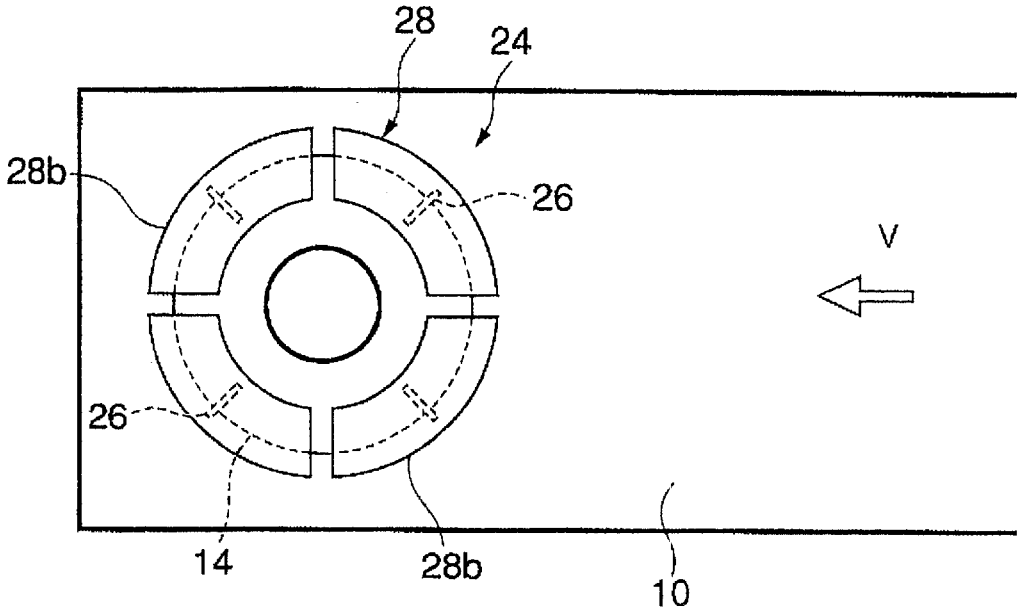
FIGS. 4A and 4B are views similar to FIG. 1B, showing other modifications of the vortex prevention apparatus according to the first embodiment of the present invention.
Figure 4B:
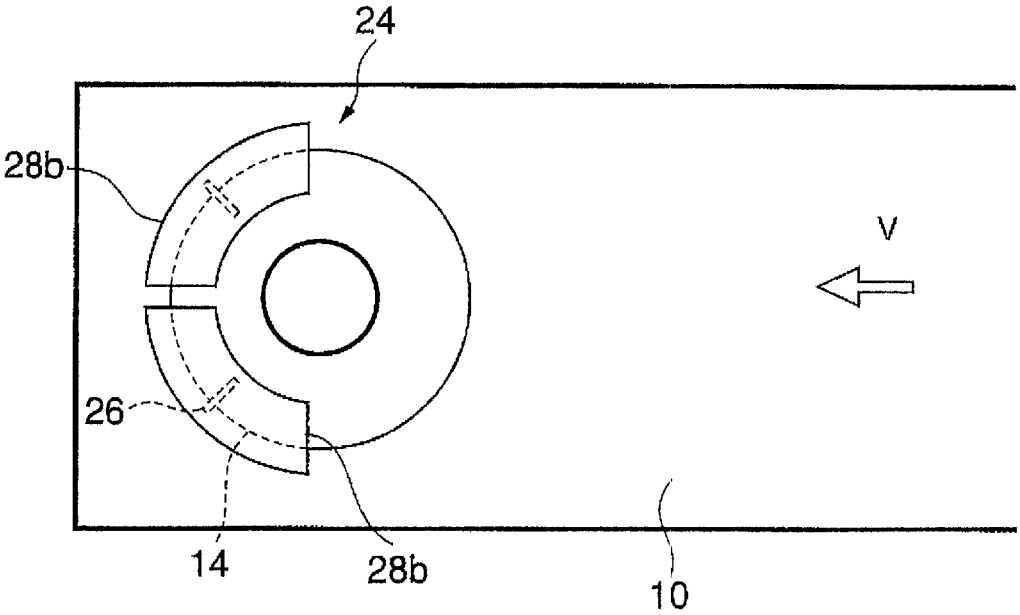

As shown in FIG. 4A, the disk-shaped auxiliary flow-path forming plate 28 may be radially slit into a plurality of (four in FIG. 4A) divided members 28*b*. As shown in FIG. 4B, such divided members 28*b* may be disposed only in a desired position, e.g., a position downstream side of the bell mouth in the channel, where air entrained vortexes are likely to be produced.

Figure 5:
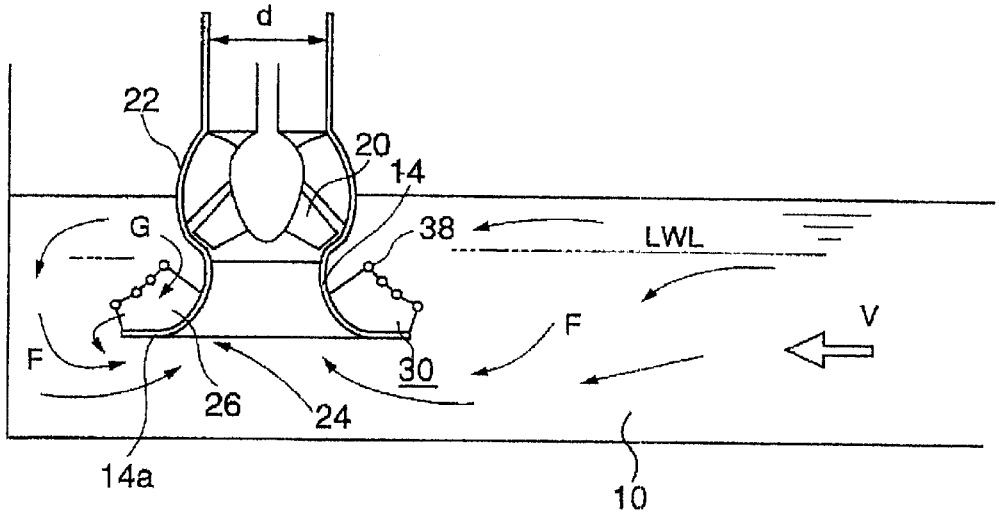
FIG. 5 is a cross-sectional view showing another modified vortex prevention apparatus.

As shown in FIG. 5, the auxiliary flow-path forming structure may comprise ring-shaped pipes 38 to define an auxiliary flow path 30 between the ring-shaped pipes 38 and the outer circumferential surface of the suction bell mouth 14. In the embodiment shown in FIG. 5, four ring-shaped pipes 38 are disposed parallel to each other and extend substantially along the outer circumferential surface of the suction bell mouth 14. However, the auxiliary flow-path forming structure may comprise a single ring-shaped pipe 38 which may be helically wound along the suction bell mouth 14.

Figure 6A:
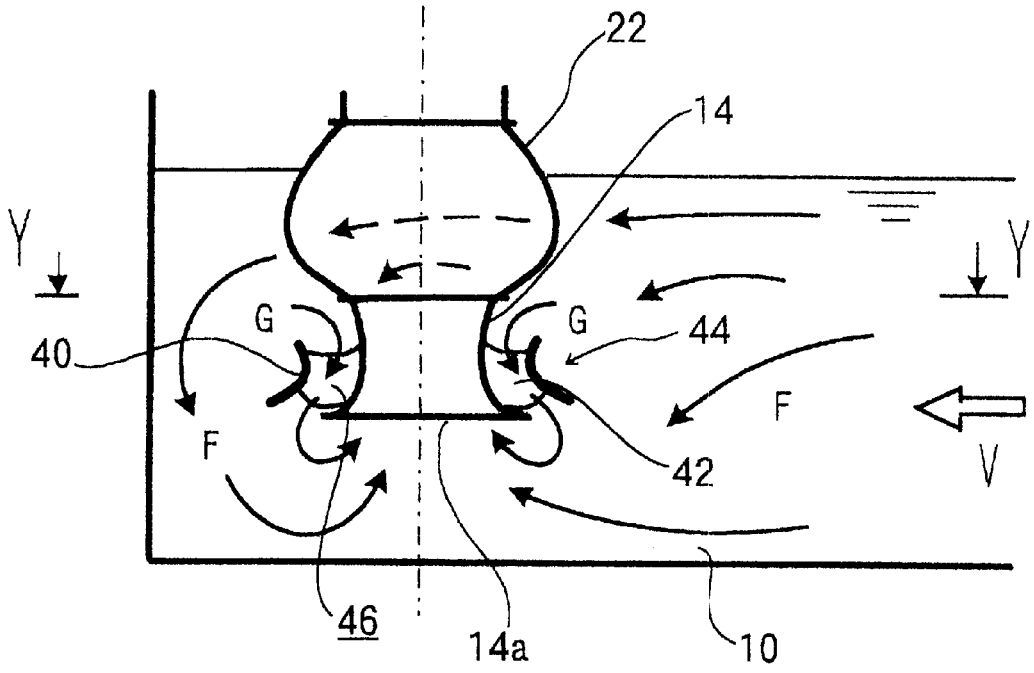
FIG. 6A is a cross-sectional view showing a vortex prevention apparatus according to a second embodiment of the present invention.
Figure 6B:
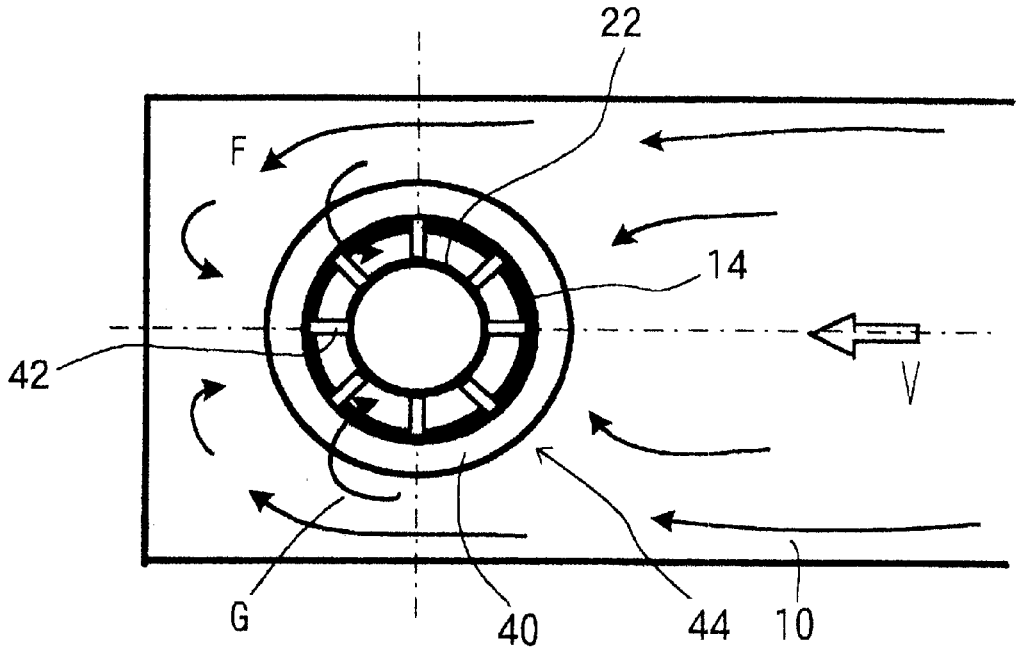
FIG. 6B is a cross-sectional view taken along line Y—Y of FIG. 6A.
Figure 7:
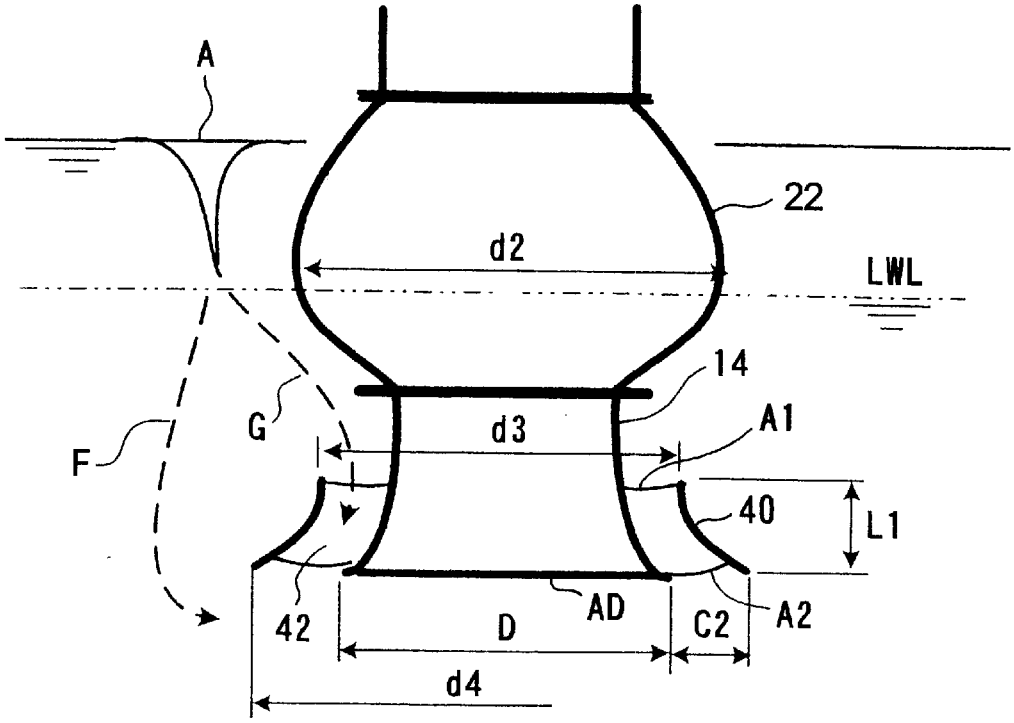
FIG. 7 is an enlarged cross-sectional view showing a portion of the vortex prevention apparatus shown in FIG. 6A.

FIGS. 6A, 6B, and 7 show a vortex prevention apparatus in a pump according to a second embodiment of the present invention. The vortex prevention apparatus has a suction bell mouth structure 44 comprising a substantially cylindrical auxiliary flow-path forming plate (auxiliary flow-path forming member) 40 disposed around and spaced by a certain distance from the outer circumferential surface of the suction bell mouth 14 and joined thereto by ribs 42. The auxiliary flow-path forming plate 40 is of a shape similar to and larger than the suction bell mouth 14. A gap of the auxiliary flow path 46 having a substantially constant dimension $C_2$ over its entire length is defined between the outer circumferential surface of the suction bell mouth 14 and the inner circumferential surface of the auxiliary flow-path forming plate 40.

The dimension $C_2$ of the auxiliary flow path 46 may be substantially constant from the inlet to outlet thereof. However, the flow path area of the inlet and the flow path area of the outlet may be changed depending on the structure of the pump. Specifically, the dimension may preferably be determined in such a manner that the area of the auxiliary flow path inlet A1 is in the range of 30 to 100% of the area $\pi D^2/4$ of the pump suction port AD and the area of the auxiliary flow path outlet A2 is in the range of 50 to 150% of the area $\pi D^2/4$ of the pump suction port AD. The auxiliary flow path 46 has a height $L_1$ which should be preferably equal to or greater than 0.15D because its vortex prevention capability would be reduced if the height $L_1$ were smaller than 0.15D. The auxiliary flow-path forming plate 40 may be replaced with a commercially available straight pipe.

In this embodiment, when the pump is operated to pump water up from the pump pit 10, a water flow directed from the water surface side toward the suction port 14*a* is also divided into a main flow F, and an auxiliary flow G along the auxiliary path 46 defined between the suction bell mouth 14 and the auxiliary flow-path forming plate 40. Therefore, locally intense downward flows in the process of developing an air entrained vortex A are suppressed. Since the downward flow is divided into the main flow F and the auxiliary flow G, any produced vortexes become unstable, and hence air entrained vortexes are prevented from being produced. The ribs 42 on which the auxiliary flow-path forming plate 40 is mounted assist in dividing the downward flow into the main flow F and the auxiliary flow G.

Figure 8:
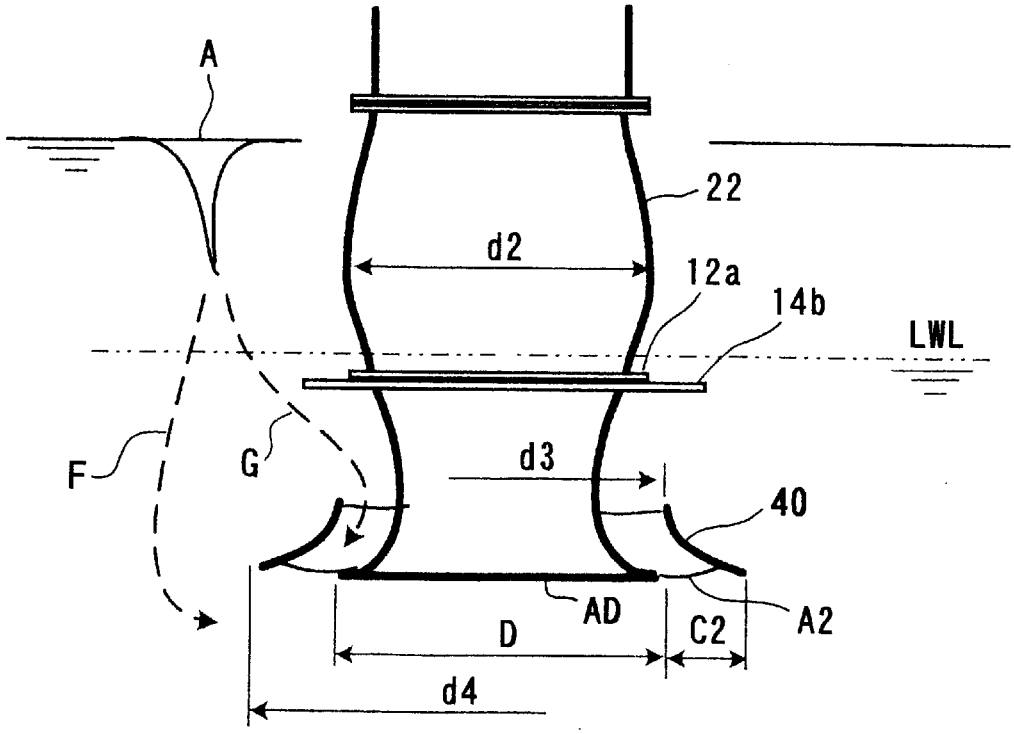
FIG. 8 is a view similar to FIG. 7, showing a modification of the vortex prevention apparatus according to the second embodiment of the present invention.

In the present embodiment, since the cylindrical auxiliary flow-path forming plate 40 is used, the maximum diameter $d_4$ of the outlet thereof can be reduced, as shown in FIG. 7. If the diameter $d_3$ of the inlet of the auxiliary flow-path forming plate 40 is smaller than the maximum diameter $d_2$ of the discharge bowl 22, then vortexes are less likely to be formed at a position immediately above the auxiliary flow path inlet, resulting in a greater vortex prevention capability. As shown in FIG. 8, if the maximum diameter $d_2$ of the discharge bowl 22 is small, then a flange 14*b* of the suction bell mouth 14 may be made greater than the diameter $d_3$ of the inlet of the auxiliary flow-path forming plate 40 to thus increase the vortex prevention capability. The flange 14*b* of the suction bell mouth 14 is positioned below the lowest low-water level LWL.

Figure 9A:
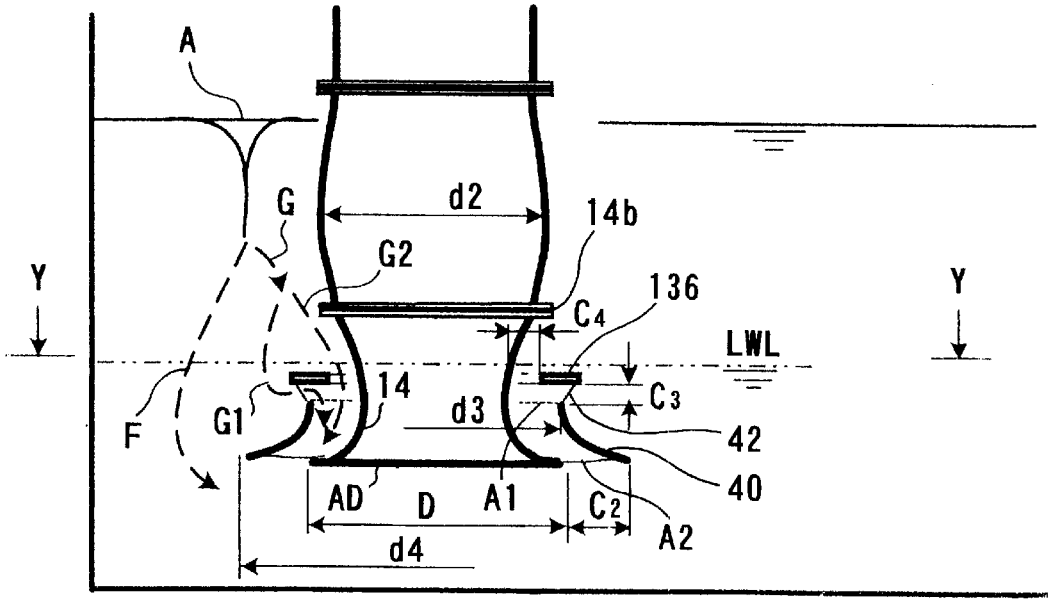
FIG. 9A is a cross-sectional view showing a modified vortex prevention apparatus.
Figure 9B:
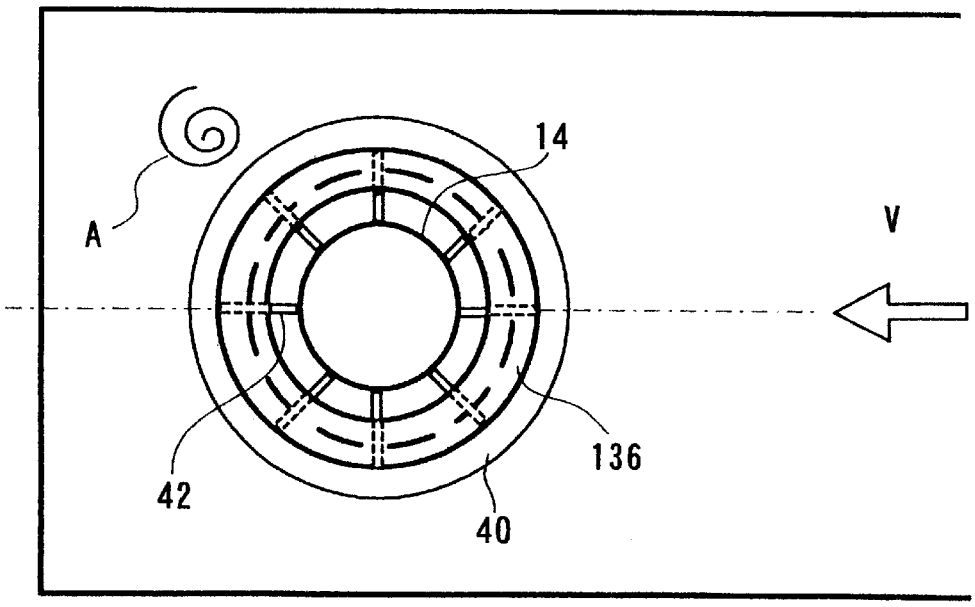
FIG. 9B is a cross-sectional view taken along line Y—Y of FIG. 9A.

FIGS. 9A and 9B show a modified vortex prevention apparatus which has a disk-shaped auxiliary top plate 136 having a central hole and spaced upwardly from the auxiliary flow-path forming plate 40 by a gap having a predetermined dimension $C_3$. The auxiliary top plate 136 offers the same advantages as those described above without an increase in the size of the flange 14*b* of the suction bell mouth 14. The auxiliary top plate 136 is of such a size that it projects radially outwardly and inwardly of a position corresponding to the diameter $d_3$ of the inlet of the auxiliary flow-path forming plate 40, and is positioned below the lowest low-water level LWL. The dimension $C_3$ between the auxiliary flow-path forming plate 40 and the auxiliary top plate 136 is selected such that the area formed by the dimension $C_3$ is in the range of 0.3 to 0.8 of the area of the auxiliary flow path inlet A1. The horizontal gap between the outer wall surface of the suction bell mouth 14 and the auxiliary top plate 136 has a dimension $C_4$ selected such that the area formed by the dimension $C_4$ is about one-half of the area of the auxiliary flow path inlet A1. This structure is effective in dividing the auxiliary flow G into two divided flows $G_1$, $G_2$ for an increased vortex prevention capability, in addition to the vortex prevention capability provided by the flange 14*b* shown in FIG. 8.

Figure 10:
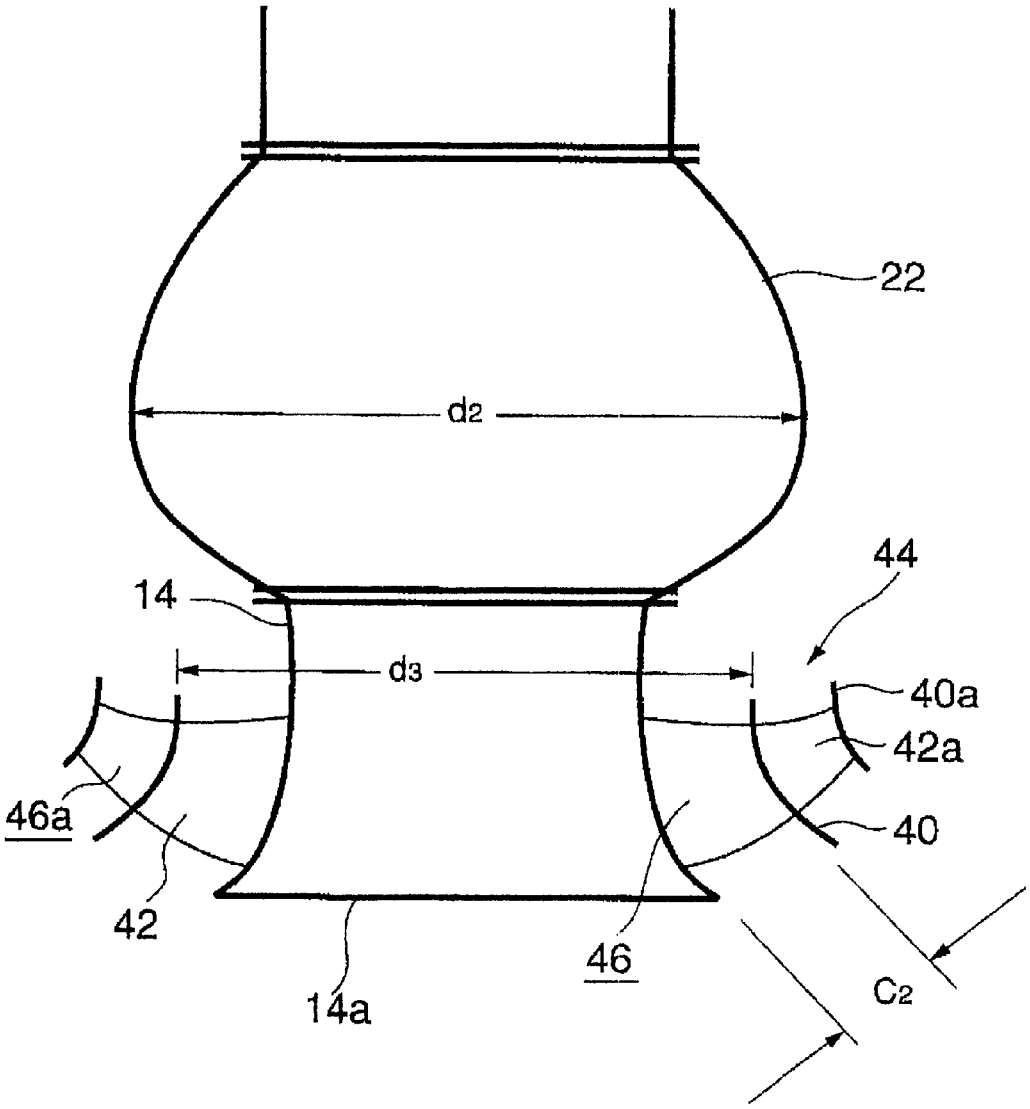
FIG. 10 is a view similar to FIG. 7, showing another modified vortex prevention apparatus.

As shown in FIG. 10, a second auxiliary flow-path forming plate 40*a* which is radially outwardly spaced by a certain distance from the auxiliary flow-path forming plate 40 may be mounted on the auxiliary flow-path forming plate 40 by second ribs 42*a*, thus defining a second auxiliary flow path 46*a* between the auxiliary flow-path forming plates 40, 40*a*.

Figure 11:
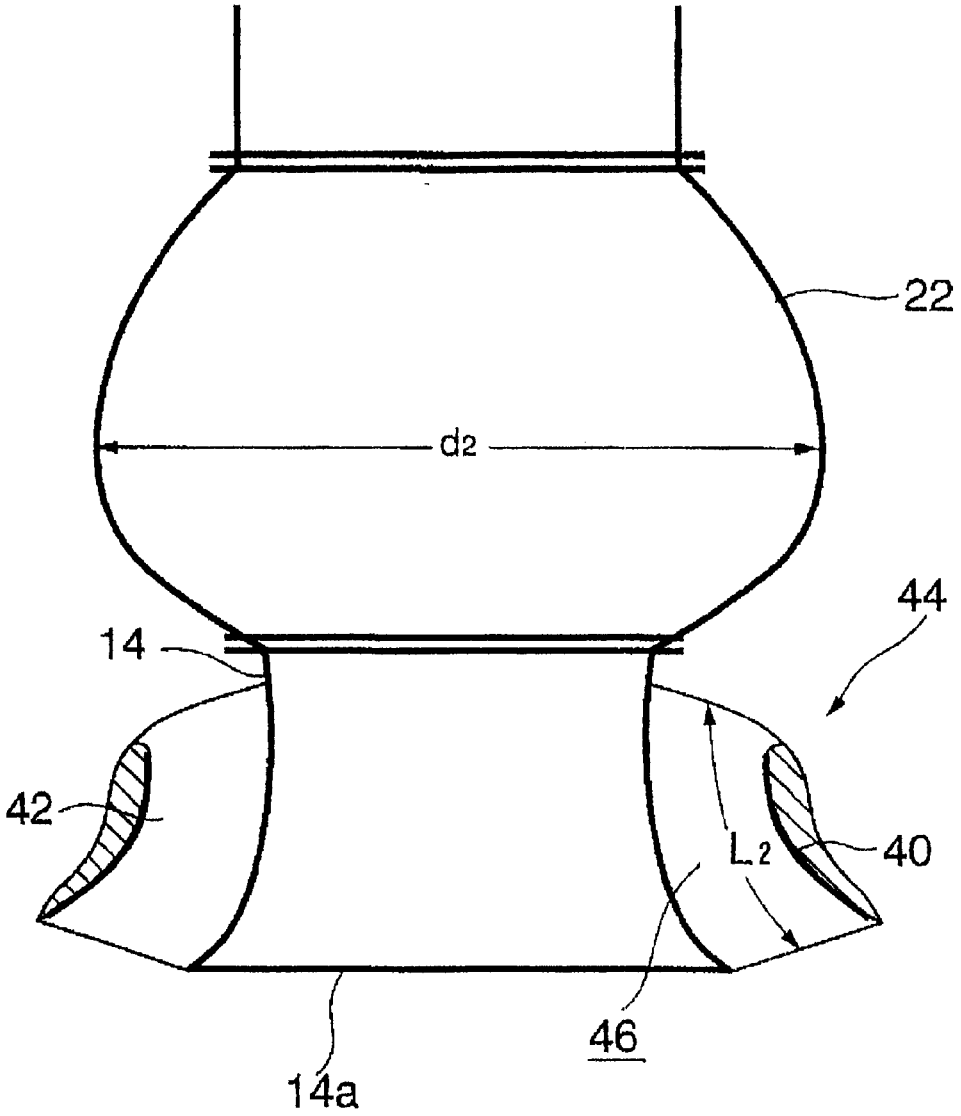
FIG. 11 is a view similar to FIG. 7, showing still another modified vortex prevention apparatus.

As shown in FIG. 11, the auxiliary flow-path forming plate 40 may have a wing-like cross-sectional shape having a round thicker upper end and tapered progressively toward its lower end, for thereby developing a velocity difference between flows along outer and inner surfaces of the auxiliary flow-path forming plate 40. Each of the ribs 42 may have an upper edge extending arcuately upwardly from the upper end of the auxiliary flow-path forming plate 40 and a lower edge extending to the lower end of the auxiliary flow-path forming plate 40. Each of the ribs 42 may have a sufficiently large length $L_2$ along the auxiliary flow path 46.

The velocity difference developed between flows along the outer and inner surfaces of the auxiliary flow-path forming plate 40 is effective to prevent foreign matter such as long foreign matter from being attached to the upper edge of the auxiliary flow-path forming plate 40. The sufficiently large length $L_2$ of the ribs 42 along the auxiliary flow path 46 is effective to prevent foreign matter from being attached to the upper edges of the ribs 42. The length $L_2$ is about 250 mm, for example. Each of the ribs 42 may have a wing-like cross-sectional shape, similar to that of the auxiliary flow-path forming plate 40, for thereby developing a velocity difference between flows along both surfaces thereof. This structure of the ribs 42 prevents foreign matter from being attached to the upper edges of the ribs 42.

Figure 12A:
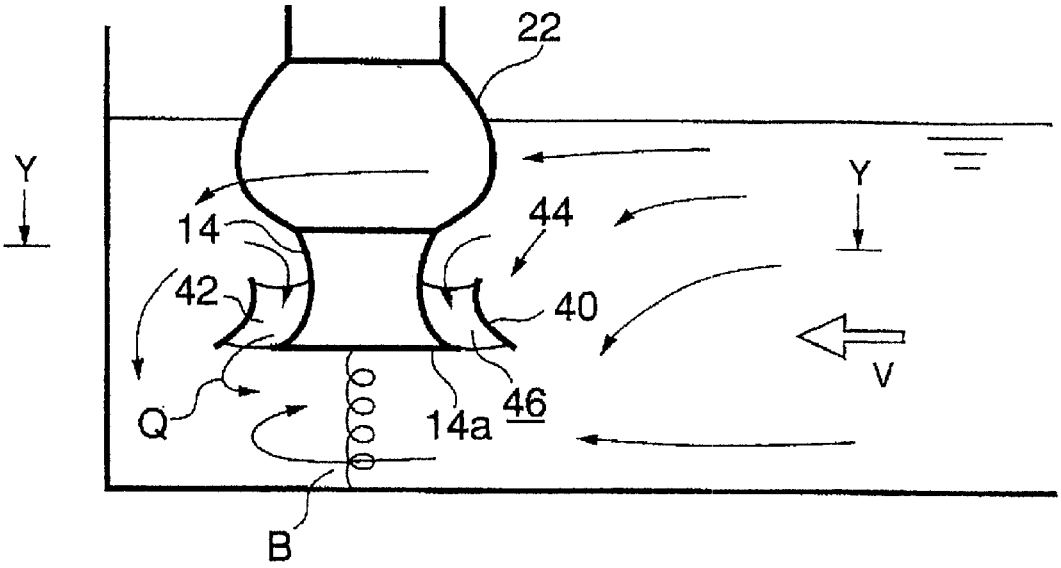
FIG. 12A is a cross-sectional view showing another modified vortex prevention apparatus.
Figure 12B:
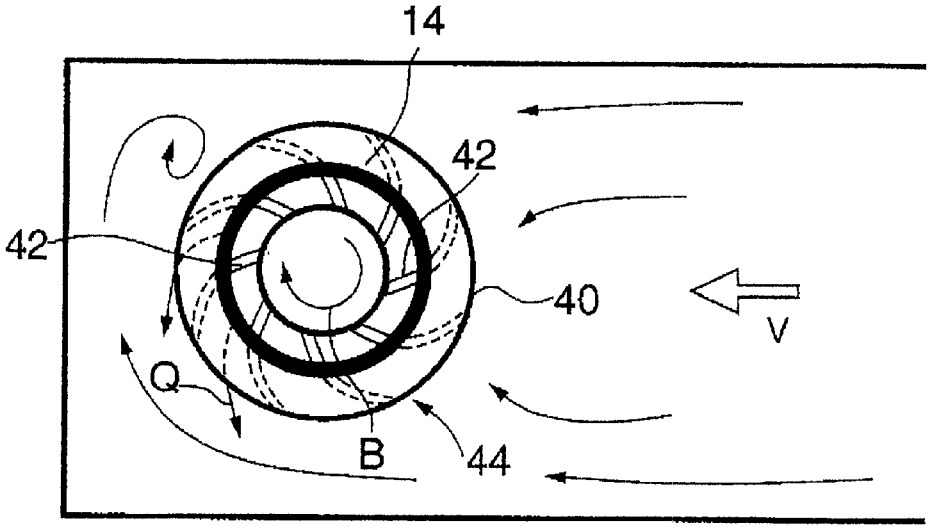
FIG. 12B is a cross-sectional view taken along line Y—Y of FIG. 12A.

As shown in FIGS. 12A and 12B, each of the ribs 42 may have an arcuate transverse cross-sectional shape extending in one direction for imparting a circumferential pre-swirling flow Q to the flow along the auxiliary flow path 46 between the auxiliary flow-path forming plate 40 and the suction bell mouth 14. When a submerged vortex B swirls in a constant direction at all times, as shown in FIGS. 12A and 12B, the submerged vortex B can be attenuated or eliminated by imparting the pre-swirling flow Q to the auxiliary flow along the auxiliary flow path 46 in a direction to cancel out the submerged vortex B.

Figure 13A:
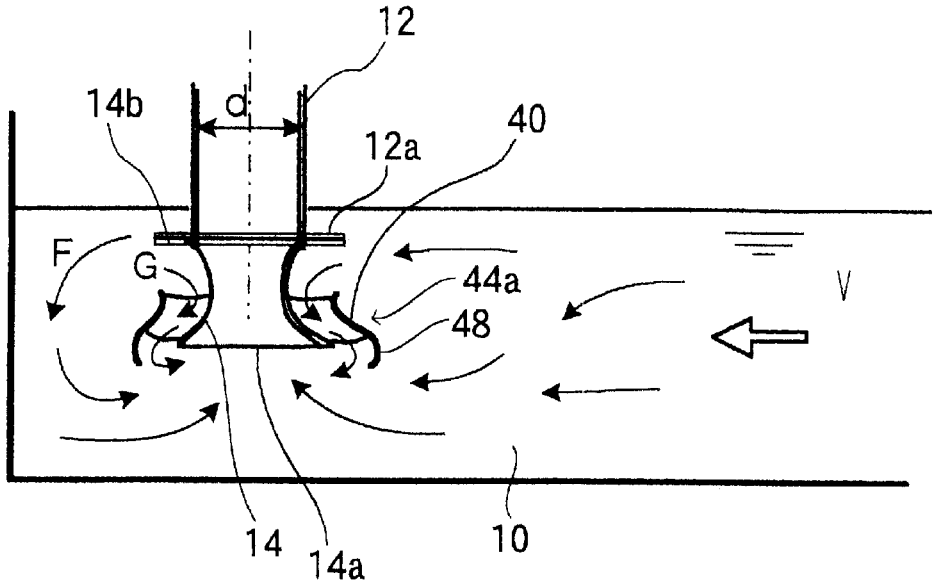
FIG. 13A is a cross-sectional view showing a vortex prevention apparatus according to a third embodiment of the present invention.
Figure 13B:
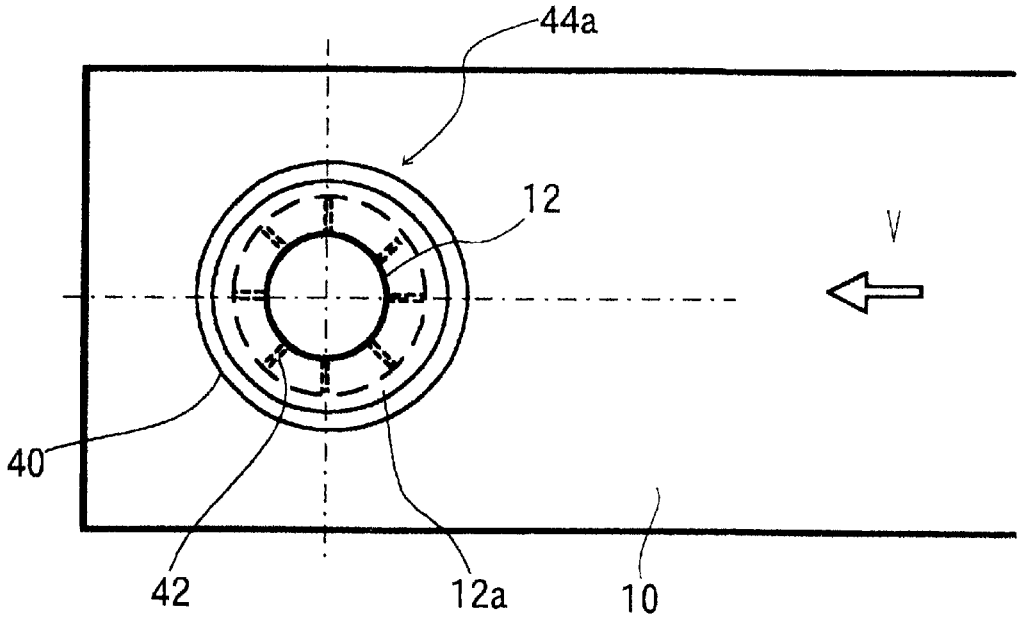
FIG. 13B is a plan view of the vortex prevention apparatus shown in FIG. 13A.

FIGS. 13A and 13B show a vortex prevention apparatus according to a third embodiment of the present invention. The pump vortex prevention apparatus includes a flange 12*a* provided on the lower end of the suction casing 12 and a flange 14*b* provided on the upper end of the suction bell mouth 14. The suction bell mouth 14 is connected to the lower end of the suction casing 12 by the flanges 12*a*, 14*b*. A suction bell mouth structure 44*a* includes a bent guide 48 integrally joined to the lower end of the auxiliary flow-path forming plate 40 in the second embodiment, the bent guide 48 being curved toward the suction port 14*a*. Other details of the pump vortex prevention apparatus according to the third embodiment are identical to those of the pump vortex prevention apparatus according to the second embodiment.

In the third embodiment, the flanges 12*a*, 14*b* disposed immediately above the auxiliary flow path inlet are effective to prevent an air entrained vortex, which would otherwise be drawn from the water surface by the auxiliary flow G along the auxiliary flow path 46 between the suction bell mouth 14 and the auxiliary flow-path forming plate 40, from being produced. The guide 48 guides the auxiliary flow G to be introduced smoothly into the suction port 14*a*, resulting in a reduced inlet loss at the suction port 14*a*.

Figure 14A:
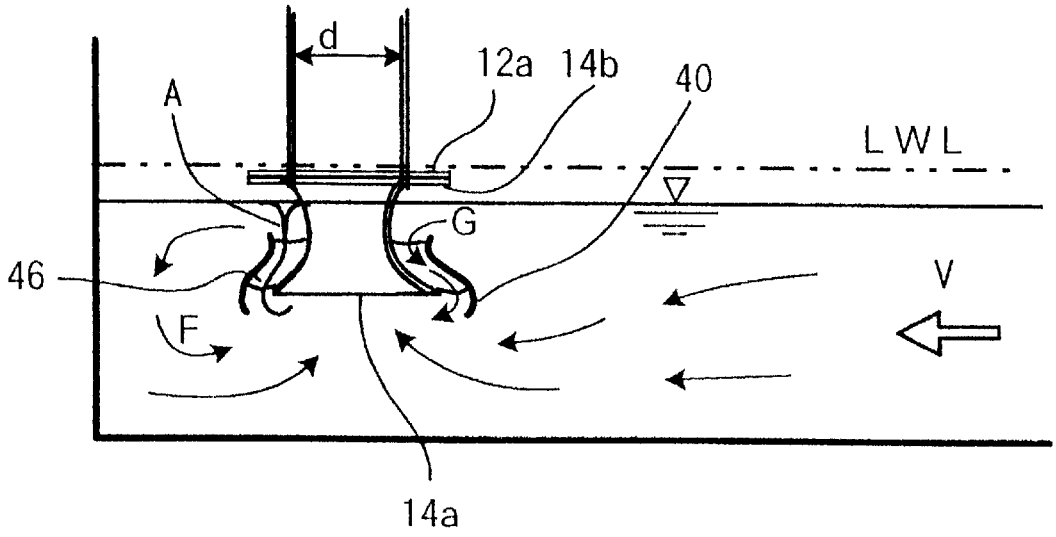
FIG. 14A is a cross-sectional view showing a vortex prevention apparatus which is arranged to operate at a low water level.
Figure 14B:
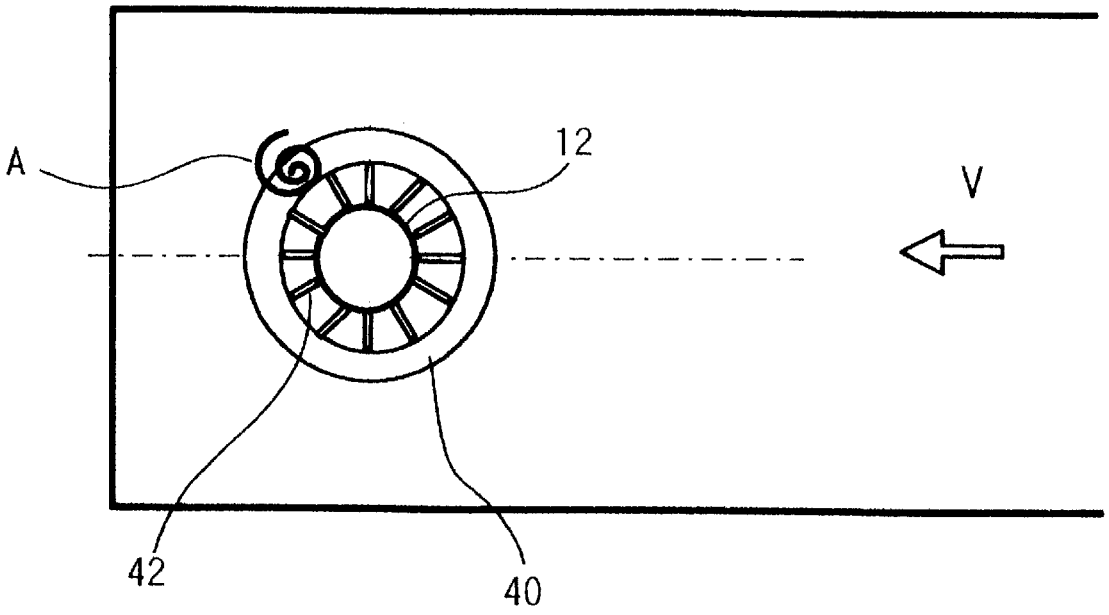
FIG. 14B is a plan view of the vortex prevention apparatus shown in FIG. 14A.

FIGS. 14A and 14B show the manner in which the vortex prevention apparatus according to the third embodiment can be operated when the water level is very low. When the water level is equal to or higher than the lowest low-water level LWL, no vortexes are generally produced. However, as shown in FIGS. 14A and 14B, when the water level is lowered to a level below the flange 14*b* of the suction bell mouth 14, an air entrained vortex A tends to be produced. In such a condition, the flow path area of the auxiliary flow path 46 may be reduced, and the number of the ribs 42 spaced at a given pitch in the circumferential direction may be increased to provide smaller passages in the auxiliary flow path 46. With such a structure, even when an air entrained vortex A is produced in the auxiliary flow path 46, such vortex is weak and small, and poses only a small impact on the impeller as it passes through the impeller. Therefore, such an air entrained vortex A is not detrimental to the operation of the pump. Specifically, since an air entrained vortex is dispersed by the auxiliary flow-path forming plate 40 and the ribs 42 and then introduced into the suction port 14*a* of the suction bell mouth 14, air can be introduced into the pump. Accordingly, the pump can be operated in an advance standby mode at all water levels, without using an air pipe.

Figure 15A:
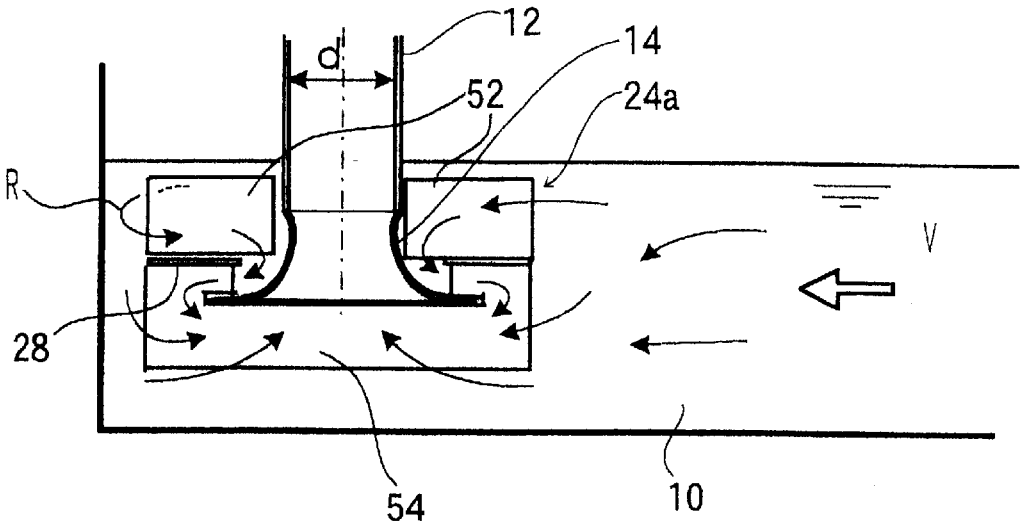
FIG. 15A is a cross-sectional view showing a vortex prevention apparatus according to a fourth embodiment of the present invention.
Figure 15B:
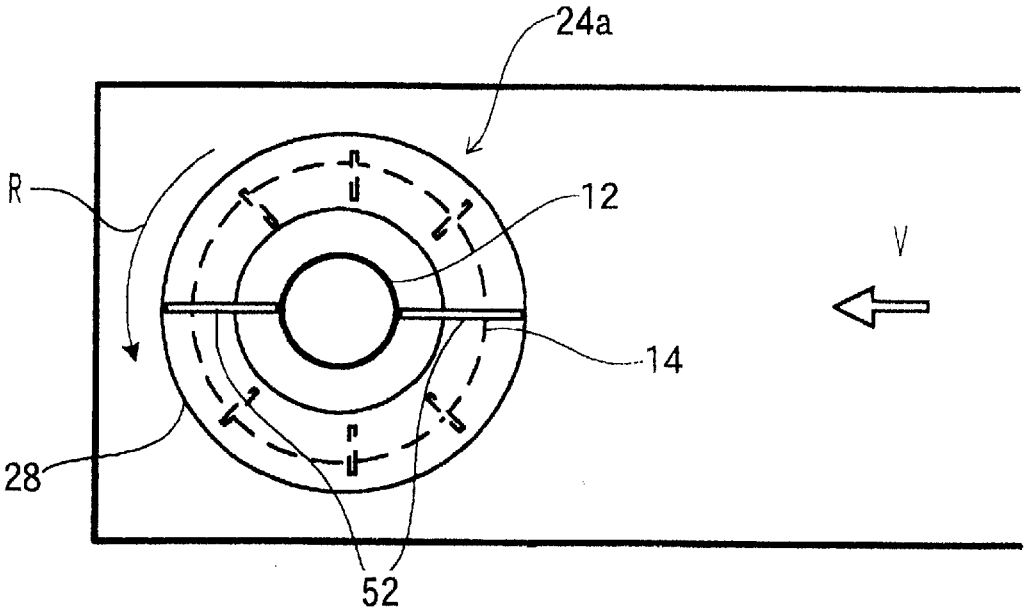
FIG. 15B is a plan view of FIG. 15A.

FIGS. 15A and 15B show a vortex prevention apparatus according to a fourth embodiment of the present invention. As shown in FIGS. 15A and 15B, the vortex prevention apparatus has a suction bell mouth structure 24*a* including an auxiliary flow-path forming plate 28, which is identical to the auxiliary flow-path forming plate 28 according to the first embodiment, mounted on the lower end of the suction casing 12, and an upper swirling flow prevention plate 52 and a lower swirling flow prevention plate 54 mounted respectively to upper and lower surfaces of the auxiliary flow-path forming plate 28 and extending linearly and vertically along flows. Other details of the vortex prevention apparatus according to the fourth embodiment are identical to those of the vortex prevention apparatus according to the second embodiment.

The upper swirling flow prevention plate 52 and the lower swirling flow prevention plate 54 are capable of preventing air entrained vortexes and submerged vortexes from being produced, even if a swirling flow R is generated around the pump. Such a swirling flow prevention plate may be mounted on the outer circumferential surface of the cylindrical auxiliary flow-path forming plate according to the second embodiment to thus prevent air entrained vortexes and submerged vortexes from being produced.

Figure 16A:
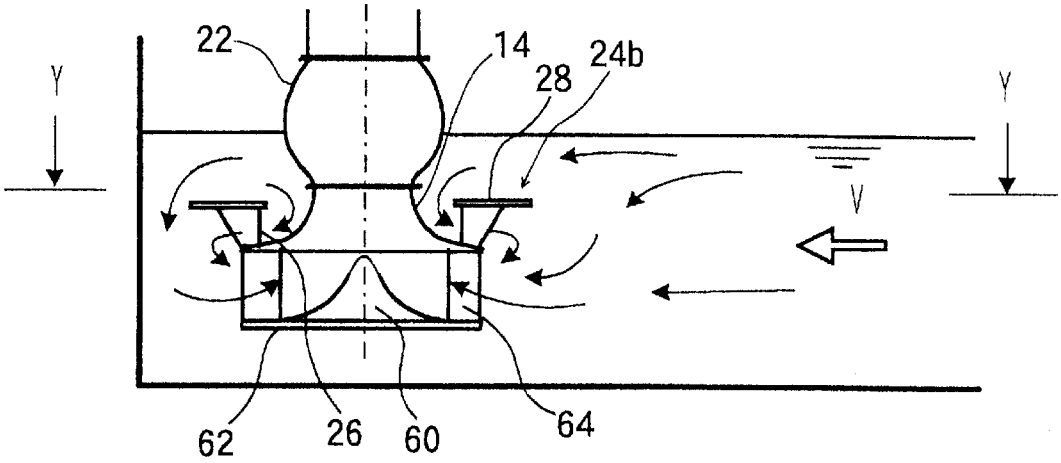
FIG. 16A is a cross-sectional view showing a vortex prevention apparatus according to a fifth embodiment of the present invention.
Figure 16B:
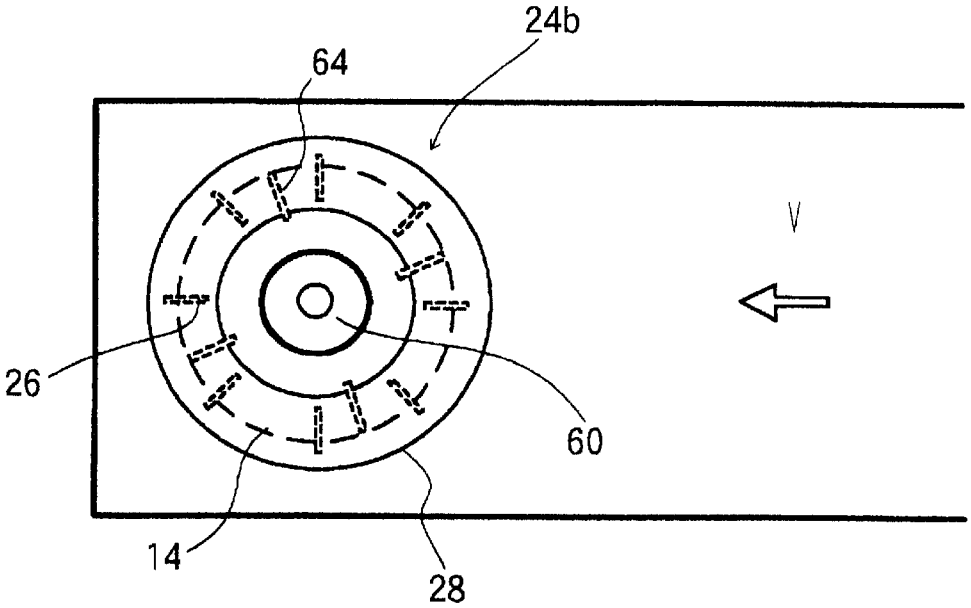
FIG. 16B is a cross-sectional view taken along line Y—Y of FIG. 16A.

FIGS. 16A and 16B show a vortex prevention apparatus according to a fifth embodiment of the present invention. As shown in FIGS. 16A and 16B, the vortex prevention apparatus has a suction bell mouth structure 24*b* including an auxiliary flow-path forming plate 28, which is identical to the auxiliary flow-path forming plate 28 according to the first embodiment, mounted on the suction bell mouth 14 from which a bottom plate 62 having a suction cone 60 is suspended by ribs 64. Other details of the vortex prevention apparatus according to the fifth embodiment are identical to those of the pump vortex prevention apparatus according to the first embodiment.

According to this embodiment, the auxiliary flow-path can prevent the air entrained vortex from being produced, and the suction cone also can prevent the submerged vortex from being produced.

Figure 17A:
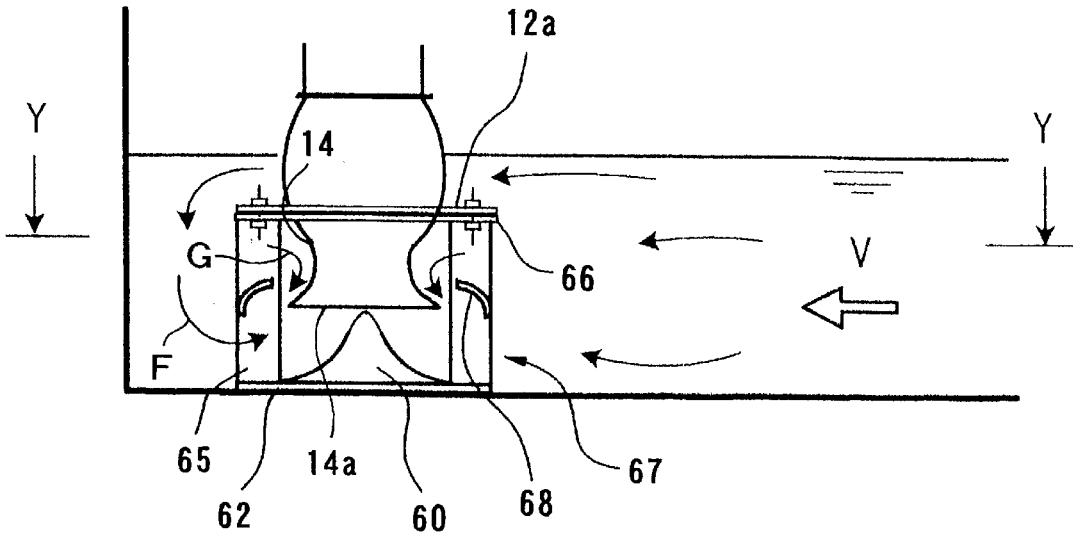
FIG. 17A is a cross-sectional view showing a vortex prevention apparatus according to a sixth embodiment of the present invention.
Figure 17B:
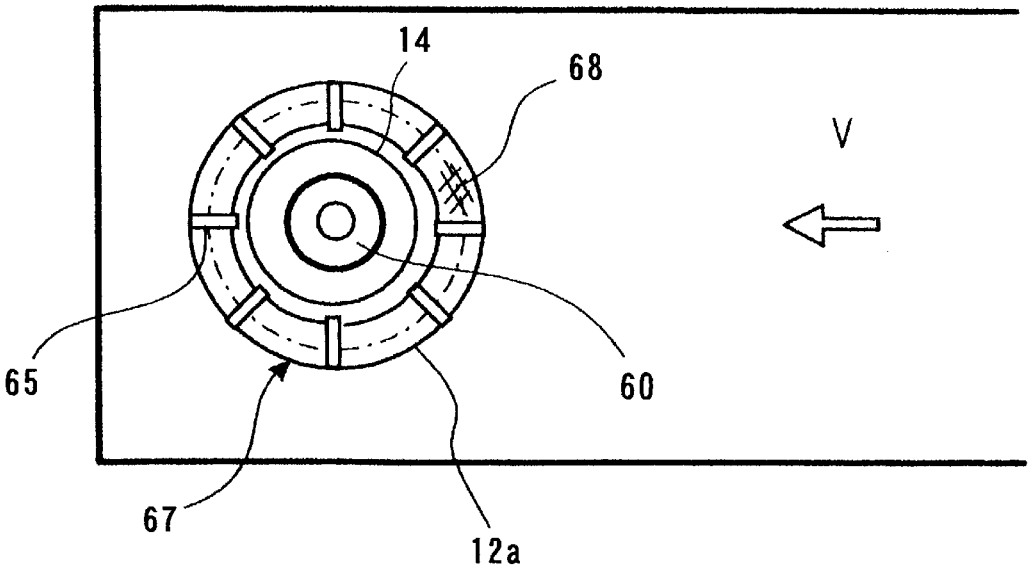
FIG. 17B is a cross-sectional view taken along line Y—Y of FIG. 17A.

FIGS. 17A and 17B show a vortex prevention apparatus according to a sixth embodiment of the present invention. In this embodiment, the pump is installed on the bottom of the water tank. As shown in FIGS. 17A and 17B, flow-rectifying ribs 65 doubling as pump installation legs are mounted on an outer peripheral edge portion of the bottom plate 62 having the suction cone 60 at circumferentially spaced intervals. The flow-rectifying ribs 65 have respective upper ends connected to a flange 66, thus providing a pump mount base 67. The flange 12*a* is integrally joined to the flange 66 by bolts. Auxiliary flow-path forming plates 68 are attached between the flow-rectifying ribs 65 in surrounding relation to the suction port 14*a* of the suction bell mouth 14 for dividing a flow directed from a portion below the water surface toward the suction port 14*a* into a main flow F passing below the auxiliary flow-path forming plates 68 and an auxiliary flow G passing above the auxiliary flow-path forming plates 68.

In the sixth embodiment, the auxiliary flow-path forming plates 68 are not directly mounted on the suction bell mouth 14, but attached between the flow-rectifying ribs 65 of the pump mount base 67. This structure is effective not only to prevent air entrained vortexes from being produced, but also to prevent submerged vortexes from being produced with the suction cone 60 and to suppress a swirling flow around the pump with the flow-rectifying ribs 65. Therefore, the vortex prevention apparatus according to the sixth embodiment offers an overall excellent vortex prevention capability. Since the auxiliary flow-path forming plates 68 are not required to be directly mounted on the suction bell mouth 14, the vortex prevention apparatus is structurally and economically advantageous.

Figure 18A:
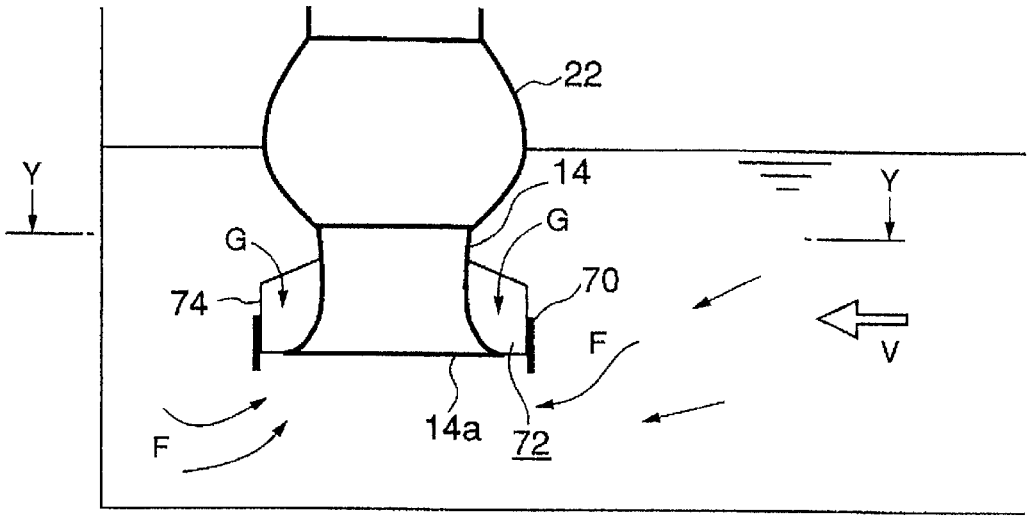
FIG. 18A is a cross-sectional view showing a vortex prevention apparatus according to a seventh embodiment of the present invention.
Figure 18B:
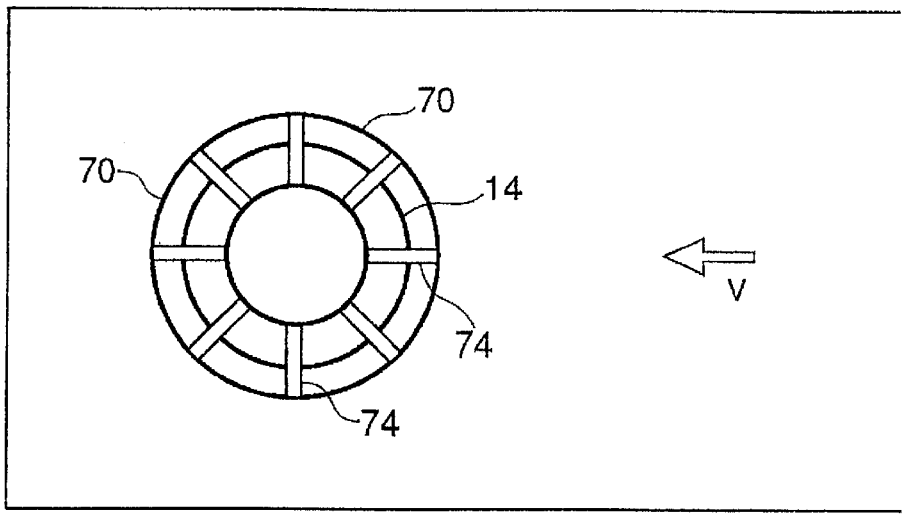
FIG. 18B is a cross-sectional view taken along line Y—Y of FIG. 18A.

FIGS. 18A and 18B show a vortex prevention apparatus according to a seventh embodiment of the present invention. As shown in FIGS. 18A and 18B, the vortex prevention apparatus has a cylindrical auxiliary flow-path forming plate (auxiliary flow-path forming member or structure) 70 surrounding the suction port 14*a* of the suction bell mouth (suction member) 14 connected to the lower end of the discharge bowl 22, thus defining an auxiliary flow path 72 extending substantially vertically between the suction bell mouth 14 and the auxiliary flow-path forming plate 70. The auxiliary flow-path forming plate 70 is fixed to the suction bell mouth 14 by ribs 74 spaced at a given pitch in the circumferential direction. The ribs 74 have upper portions projecting upwardly beyond the upper edge of the auxiliary flow-path forming plate 70, and have a length (height) which is substantially the same as the height of the suction bell mouth 14.

In the present embodiment, the length of the ribs 74 is long enough to prevent foreign matter from being attached to the upper edges of the ribs 74. Since the upper portions of the ribs 74 project from the auxiliary flow-path forming plate 70, a swirling flow R (see FIGS. 15A and 15B) around the pump is considerably prevented from being produced. Therefore, air entrained vortexes and submerged vortexes are prevented from being produced.

Figure 19:
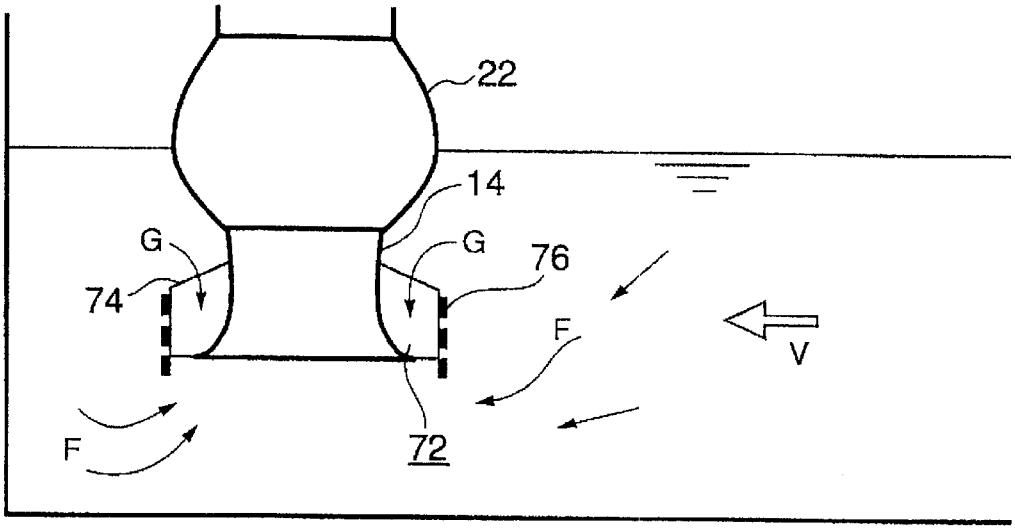
FIG. 19 is a view similar to FIG. 18A, showing a modification of the vortex prevention apparatus according to the seventh embodiment of the present invention.

As shown in FIG. 19, an auxiliary flow-path forming plate 76 having a number of apertures defined therein may be used in place of the auxiliary flow-path forming plate 70 shown in FIGS. 18A and 18B. The auxiliary flow-path forming plate 76 having the apertures makes the vortex prevention apparatus lightweight. A plurality of short cylindrical auxiliary flow-path forming plates may be employed in vertically spaced relation to form a multi-stage structure.

Figure 20A:
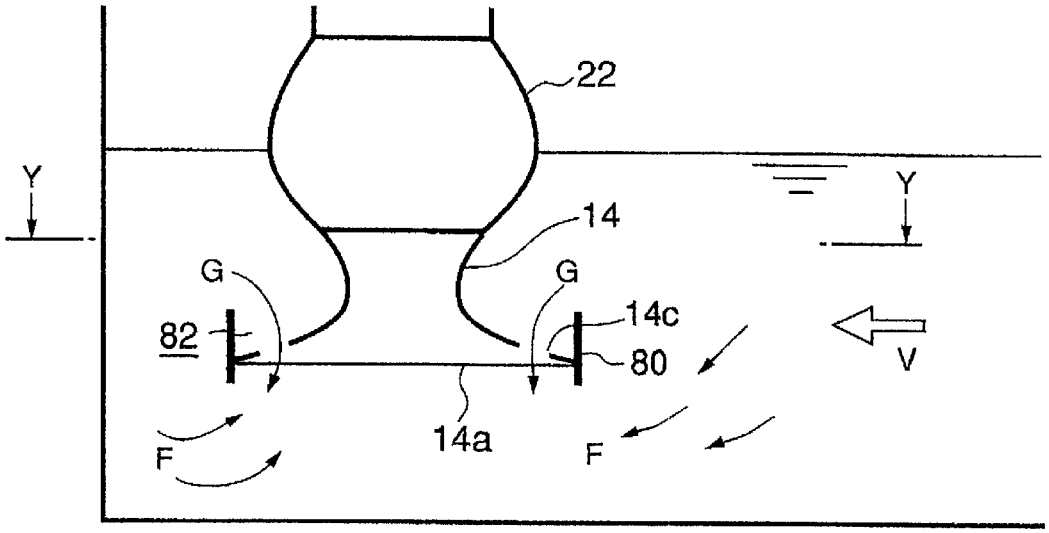
FIG. 20A is a cross-sectional view showing a vortex prevention apparatus according to an eighth embodiment of the present invention.
Figure 20B:
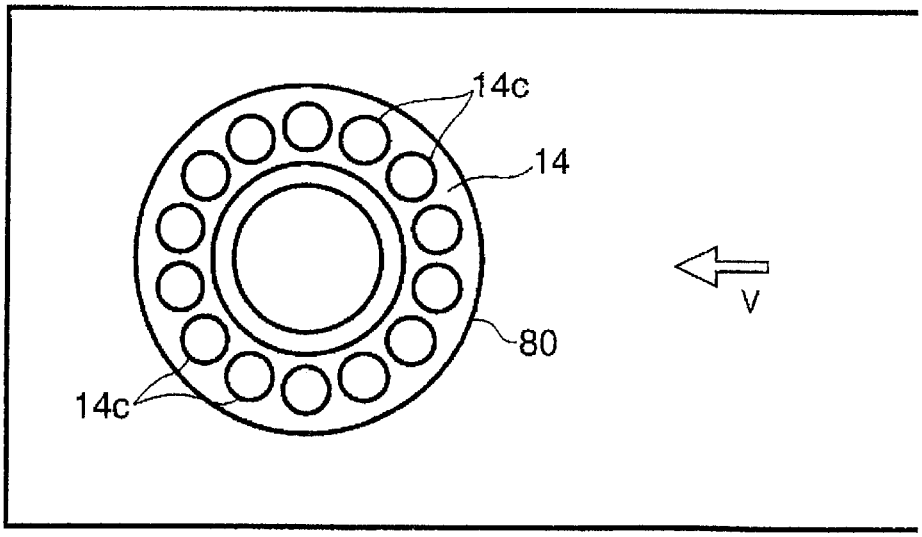
FIG. 20B is a cross-sectional view taken along line Y—Y of FIG. 20A.

FIGS. 20A and 20B show a vortex prevention apparatus according to an eighth embodiment of the present invention. As shown in FIGS. 20A and 20B, the vortex prevention apparatus has a number of circular holes 14c defined vertically through the suction bell mouth (suction member) 14 connected to the lower end of the discharge bowl 22, and a cylindrical auxiliary flow-path forming plate (auxiliary flow-path forming member or structure) 80 coupled to the outer circumferential end of the suction bell mouth 14, thus defining an auxiliary flow path 82 extending between the outer circumferential surface of the suction bell mouth 14 and the auxiliary flow-path forming plate 80 and through the holes 14*c*.

In the eighth embodiment, the vortex prevention apparatus is simple in structure as it requires no ribs for fixing the auxiliary flow-path forming plate 80. Although the circular through holes 14*c* are formed in the suction bell mouth 14, oblong or rectangular holes extending in the circumferential direction of the suction bell mouth 14 may alternatively be formed in the suction bell mouth 14.

Figure 21A:
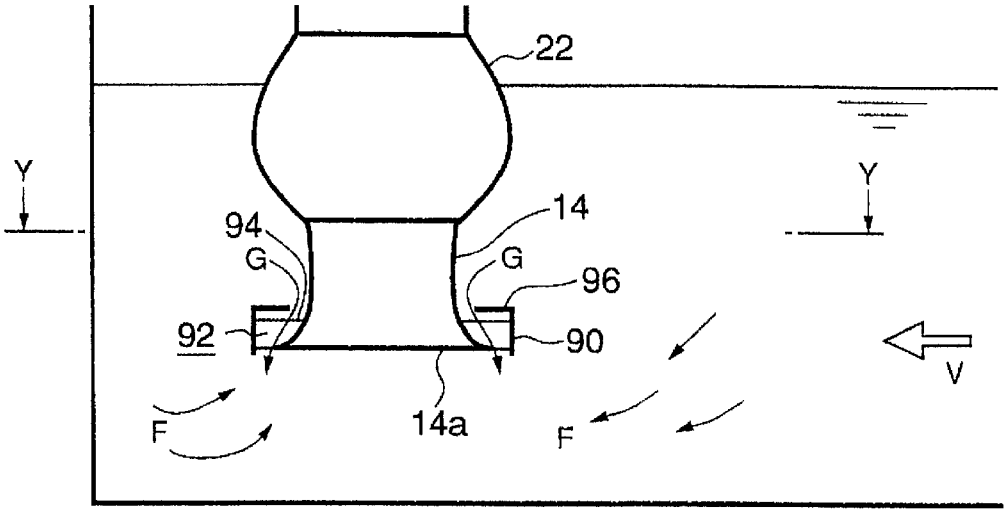
FIG. 21A is a cross-sectional view showing a vortex prevention apparatus according to a ninth embodiment of the present invention.
Figure 21B:
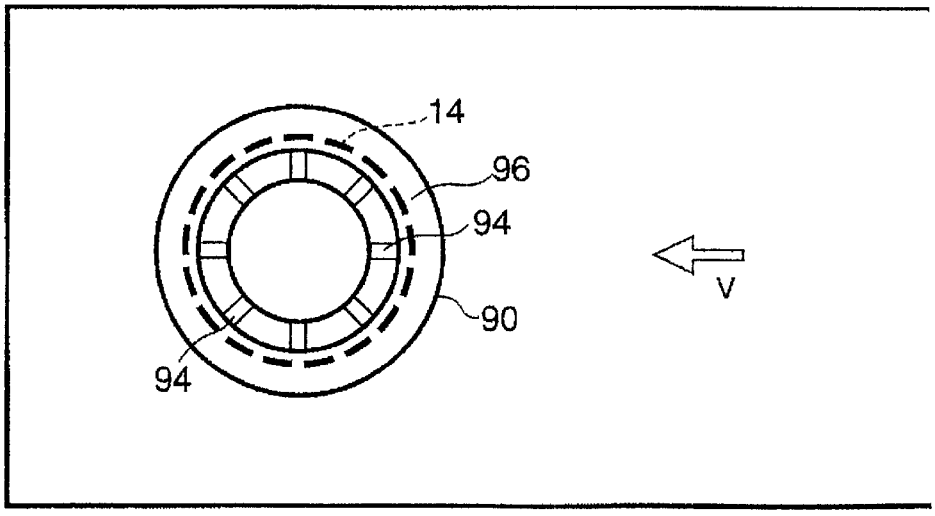
FIG. 21B is a cross-sectional view taken along line Y—Y of FIG. 21A.

FIGS. 21A and 21B show a vortex prevention apparatus according to a ninth embodiment of the present invention. As shown in FIGS. 21A and 21B, the vortex prevention apparatus has a cylindrical auxiliary flow-path forming plate (auxiliary flow-path forming structure) 90 surrounding the suction port 14*a* of the suction bell mouth (suction member) 14 connected to the lower end of the discharge bowl 22, thus defining an auxiliary flow path 92 extending substantially vertically between the suction bell mouth 14 and the auxiliary flow-path forming plate 90. The auxiliary flow-path forming plate 90 is fixed to the suction bell mouth 14 by ribs 94 spaced at a given pitch in the circumferential direction. A disk-shaped inflow adjusting plate 96 having a central hole is mounted on the upper end of the auxiliary flow-path forming plate 90.

In the ninth embodiment, the inflow adjusting plate 96 adjusts the amount of water flowing into the auxiliary flow path 92 to prevent an excessively large amount of water from flowing into the auxiliary flow path 92 for thereby preventing an air entrained vortex from being produced in the auxiliary flow path 92.

Figure 22A:
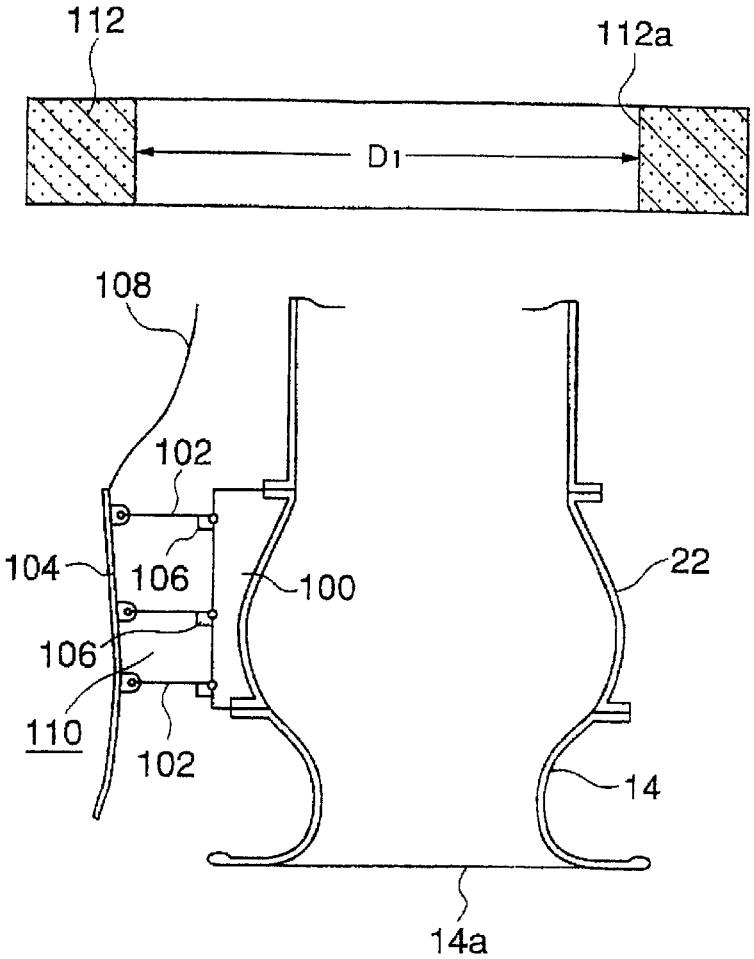
FIG. 22A is a cross-sectional view showing a vortex prevention apparatus according to a tenth embodiment of the present invention.
Figure 22B:
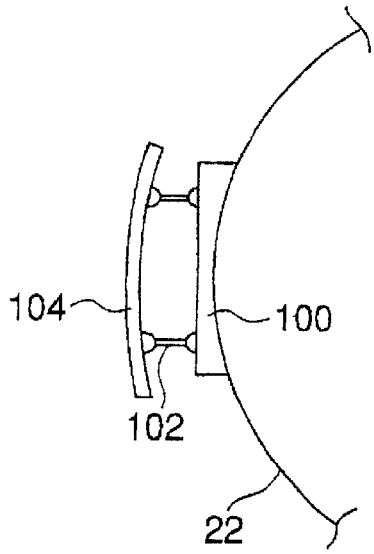
FIG. 22B is a plan view showing a divided type of auxiliary flow-path forming plate.

FIGS. 22A and 22B show a vortex prevention apparatus according to a tenth embodiment of the present invention. As shown in FIGS. 22A and 22B, the vortex prevention apparatus comprises a plurality of vortex prevention units disposed at given intervals in a cercumferential direction. Each of the vortex prevention units comprises a support plate 100 mounted on an outer circumferential surface of the discharge bowl (suction member) 22, an auxiliary flow-path forming plate (auxiliary flow-path forming structure) 104 angularly movably coupled to ends of a plurality of links 102 whose other ends are angularly movably coupled to the support plate 100, stoppers 106 mounted on the support plate 100 beneath the links 102 for limiting angular movement of the links 102, and a wire 108 connected to the auxiliary flow-path forming plate 104.

When the wire 108 is pulled upwardly, the links 102 are angularly moved upwardly to translate the auxiliary flow-path forming plate 104 upwardly while the auxiliary flow-path forming plate 104 moves closer to the discharge bowl 22. When the wire 108 is loosened, the links 102 are angularly moved downwardly by the weight of the auxiliary flow-path forming plate 104 while the auxiliary flow-path forming plate 104 moves away from the discharge bowl 22 until the links 102 are engaged by the stoppers 106. In this manner, an auxiliary flow path 110 is defined between the outer circumferential surface of the discharge bowl 22 and the auxiliary flow-path forming plate 104.

In the present embodiment, for giving a vortex prevention capability to an existing pump, the auxiliary flow-path forming plates 104 are mounted on the outer circumferential surface of the discharge bowl 22, and the wire 108 is pulled to contract the auxiliary flow-path forming plates 104 toward the discharge bowl 22. Then, the discharge bowl 22 and the auxiliary flow-path forming plates 104 are caused to pass through an opening 112*a* defined in a pump mount base 112 to install the discharge bowl 22 in a closed channel. Thereafter, the wire 108 is loosened to spread the auxiliary flow-path forming plates 104 away from the discharge bowl 22, providing the auxiliary flow path 110 between the discharge bowl 22 and the auxiliary flow-path forming plates 104. The auxiliary flow-path forming plates 104 which have a diameter greater than the dimension or diameter $D_1$ of the opening 112*a* are now disposed radially outwardly of the discharge bowl 22.

Figure 23:
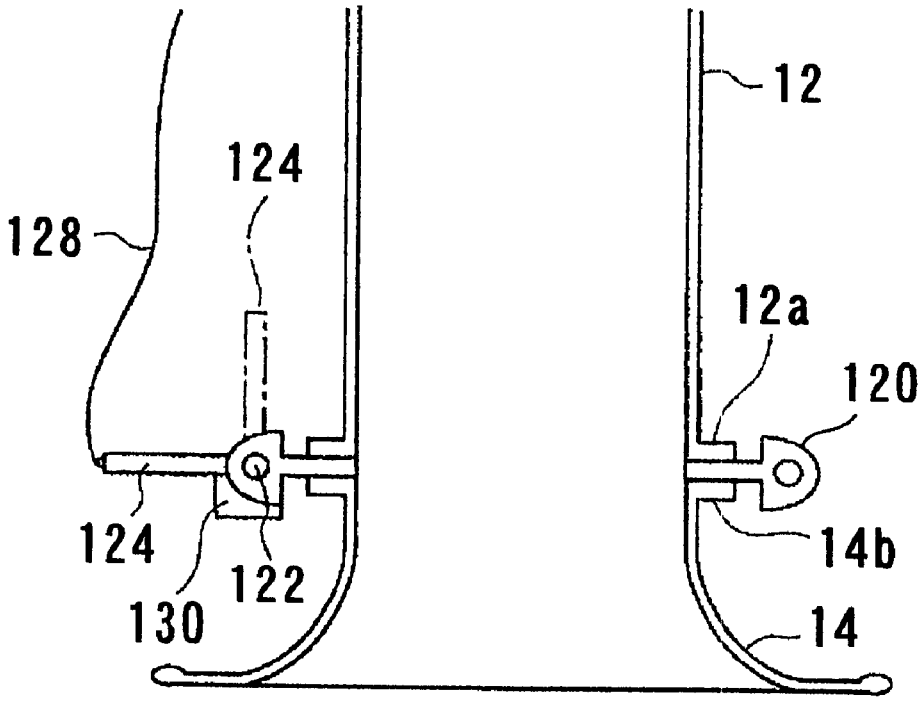
FIG. 23 is a cross-sectional view showing a modification of the vortex prevention apparatus according to the tenth embodiment of the present invention.

As shown in FIG. 23, supports 120 may be fixed between the flange 12*a* of the suction casing 12 and the flange 14*b* of the suction bell mouth 14, and divided auxiliary flow-path forming plates 124 may be swingably supported by pivot shafts 122 mounted on the respective supports 120. Wires 128 may be connected to respective free ends of the auxiliary flow-path forming plates 124. When the wires 128 are pulled upwardly, the auxiliary flow-path forming plates 124 are angularly moved upwardly and contracted radially inwardly. When the wires 128 are loosened, the auxiliary flow-path forming plates 124 are angularly moved downwardly by their own weight and spread radially outwardly until the auxiliary flow-path forming plates 124 are engaged by stoppers 130 against further downward movement.

In each of the above embodiments, a vortex prevention capability is achieved by placing an auxiliary flow-path forming member or structure around the suction member, without placing a concrete construction in the pump pit. The pump pit may be of a simple rectangular reservoir structure, and hence does not need an expenditure of additional civil engineering work for realizing a vortex prevention capability. Since the auxiliary flow-path forming member or structure can easily be installed at site, the period of time for constructing the vortex prevention apparatus is greatly shortened, and any expenditure of civil engineering work is greatly reduced.

Figure 24A:
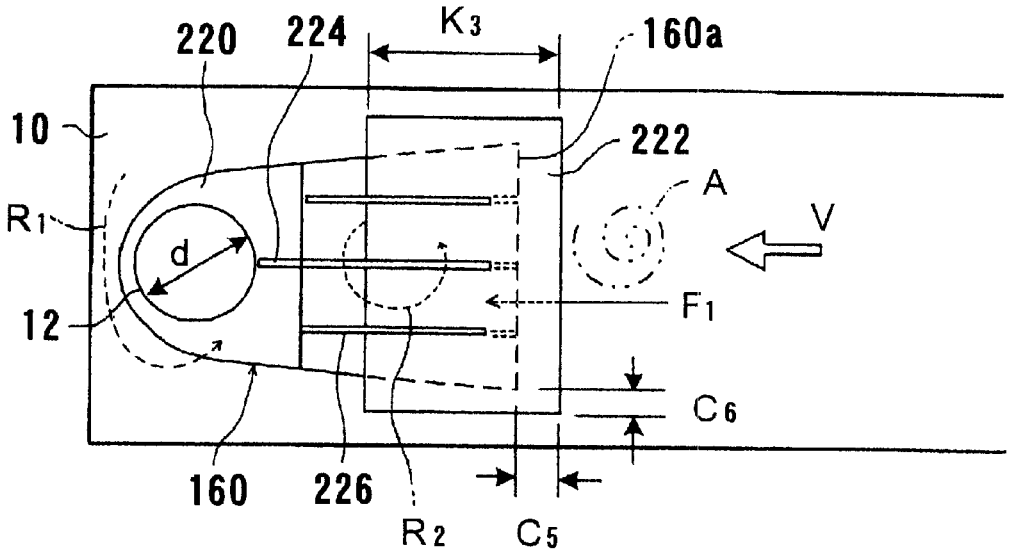
FIG. 24A is a plan view of a vortex prevention apparatus according to an eleventh embodiment of the present invention.
Figure 24B:
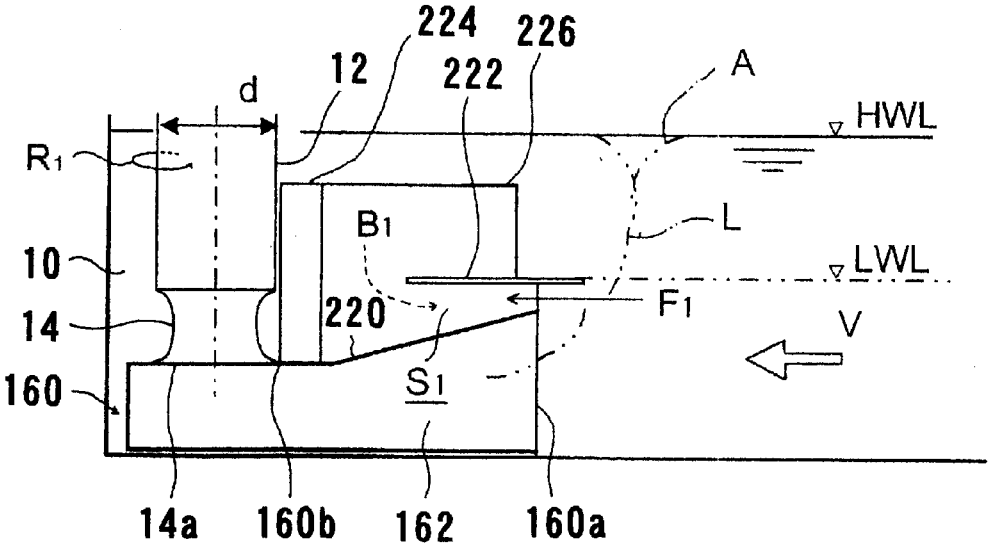
FIG. 24B is a cross-sectional view of the vortex prevention apparatus shown in FIG. 24A.

FIGS. 24A and 24B show a pump vortex prevention apparatus according to an eleventh embodiment of the present invention. As shown in FIGS. 24A and 24B, the vortex prevention apparatus has a suction bell mouth 14 coupled to the lower end of a vertical suction casing 12 disposed in the pump pit 10 of an open channel, and an inflow water channel casing (inflow water channel structure) 160 constituting a suction member in the form of a rectangular box which defines therein a closed inflow water channel 162. The inflow water channel casing 160 has a laterally open inlet port 160*a* and an upwardly open connection port 160*b*. The inflow water channel casing 160 is placed in the pump pit 10 in such a manner that the inlet port 160*a* faces upstream and the connection port 160*b* is connected to the suction port 14*a* of the suction bell mouth 14.

The inflow water channel casing 160 has a rear end disposed closely to a rear wall of the pump pit 10 in order to make it difficult for a swirling flow $R_1$ to be produced around the suction casing 12.

A rectangular flow-rectifying plate 222 extending upstream of the inlet port 160*a* in covering relation to the inlet port 160*a* is positioned above a top plate 220 of the inflow water channel casing 160. A gap $S_1$ is defined between the top plate 220 and the flow-rectifying plate 222. The flow-rectifying plate 222 has such a size that it has a front extension $C_5$ extending upstream of the inlet port 160*a* and extends downstream of the inlet port 160*a*, and also has lateral extensions $C_6$ extending laterally beyond the width of the inlet port 160*a* at both side ends thereof. The flow-rectifying plate 222 is positioned slightly below the lowest low-water level LWL.

The gap $S_1$ between the top plate 220 and the flow-rectifying plate 222 is preferably of a dimension ranging from 0.1 to 0.5 of the diameter d of the suction casing 12. The extensions $C_5$, $C_6$ are also preferably of a dimension ranging from 0.1 to 0.5 of the diameter d of the suction casing 12. The flow-rectifying plate 222 has a length $K_3$ along the water flow which is preferably about one-half of the width of the inlet port 160*a*. This structure allows shear flows having different velocities across the flow-rectifying plate 222 to be produced. When an air entrained vortex A having a vortex filament L extending between the free water surface and the inlet port 160*a* is about to be generated, a water flow $F_1$ flowing between the flow-rectifying plate 222 and the top plate 220 cuts off the vortex filament L, thus preventing such an air entrained vortex A from being produced in the pump pit 10.

A main vertical plate 224 is positioned centrally in the transverse direction of the water channel and extends vertically along the water flow. A pair of auxiliary vertical plates 226 is positioned one on each side of and parallel to the main vertical plate 224. The flow-rectifying plate 222 is mounted on the main vertical plate 224 and the auxiliary vertical plates 226 at a certain vertical position or height thereon, and the vertical plates 224, 226 have lower ends attached to the top plate 220, thus holding the flow-rectifying plate 222 in a position above the top plate 220.

The vertical plates 224, 226 extend above the flow-rectifying plate 222 to prevent a swirling flow $R_1$ from being produced around the suction casing 12 and also prevent a swirling flow $R_2$ from being produced above the inflow water channel casing 160. In the case where there is no swirling flow, the vertical plates 224, 226 are not required to extend beyond the flow-rectifying plate 222. The main vertical plate 224 is disposed in such a manner that the gap between the rear end of the main vertical plate 224 and an outer barrel of the suction casing 12 is as small as possible in order to more reliably prevent a swirling flow $R_1$ from being produced around the suction casing 12.

The auxiliary vertical plates 226 for preventing a swirling flow from being produced also serve to smoothly introduce the water flow $F_1$ into the gap $S_1$ between the flow-rectifying plate 222 and the top plate 220. The auxiliary vertical plates 226 have a length which is the same as the length $K_3$ along the water flow of the flow-rectifying plate 222, for example.

Operation of the vortex prevention apparatus according to the eleventh embodiment will be described below.

The pump is operated to discharge water from the pump pit 10. At this time, the distance from the suction port 14*a* of the suction bell mouth 14 to the free water surface where a vortex is formed is large, and the velocity of the water flow in the inlet port 160*a* is considerably lower than the velocity of the water flow in the suction port 14*a*, and hence the generation of an air entrained vortex at the free water surface can be suppressed to a certain extent. However, as the velocity V of the water flow in the water channel increases, an air entrained vortex A which has a vortex filament L extending from the free water surface to the suction port 14*a* via the inlet port 160*a* and the inflow water channel 162 is liable to be produced. Since the vortex filament L is cut off by the water flow $F_1$ flowing between the flow-rectifying plate 222 and the top plate 220, an air entrained vortex A is prevented from being produced in the pump pit 10, if the water level is higher than the lowest low-water level LWL.

The vertical plates 224, 226 prevent a swirling flow $R_1$ from being produced around the suction casing 12 and also prevent a swirling flow $R_2$ from being produced above the inflow water channel casing 160, resulting in an increased vortex prevention capability.

Figure 31A:
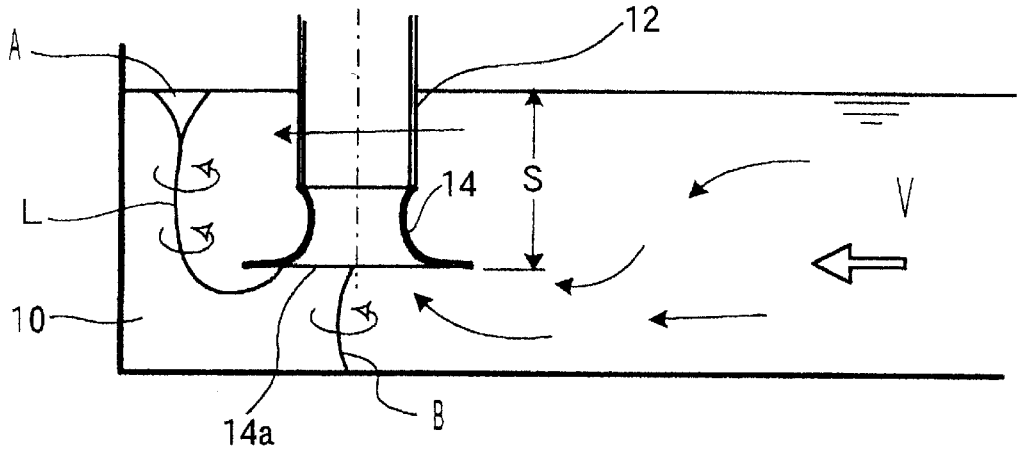
FIG. 31A is a cross-sectional view showing a conventional open channel with a water discharge pump installed therein.
Figure 31B:
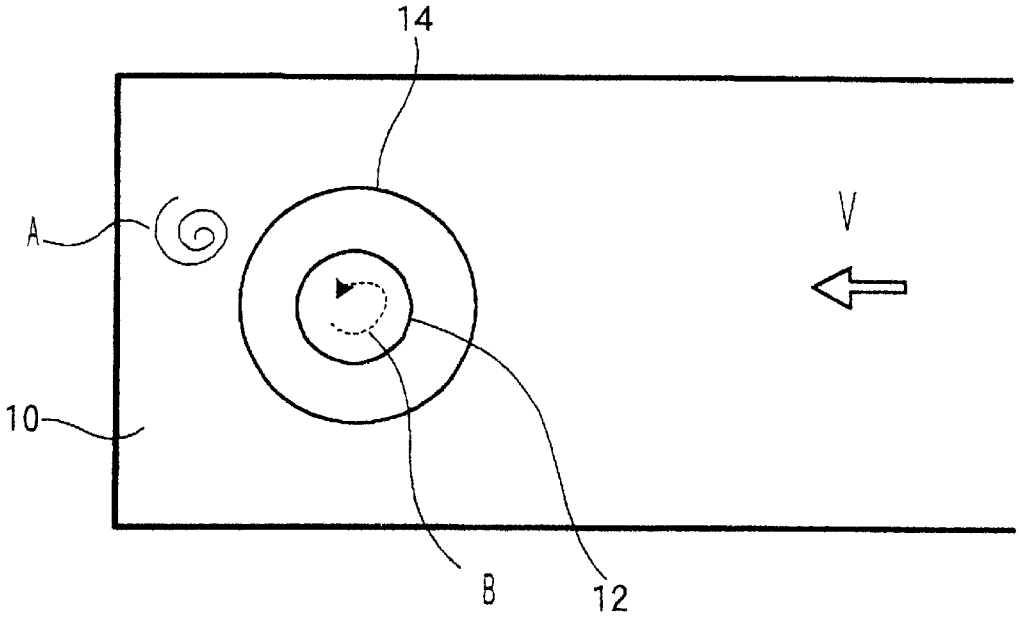
FIG. 31B is a plan view of the conventional open channel shown in FIG. 31A.
Figure 32A:
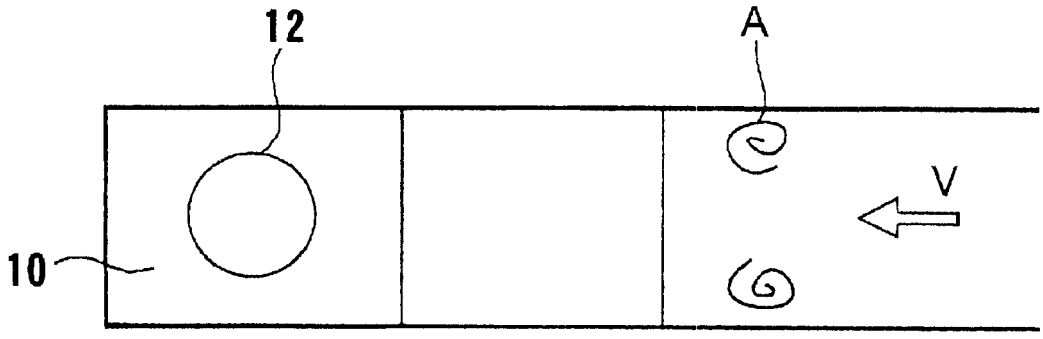
FIG. 32A is a plan view showing a conventional lateral-suction closed-type channel with a water discharge pump installed therein.
Figure 32B:
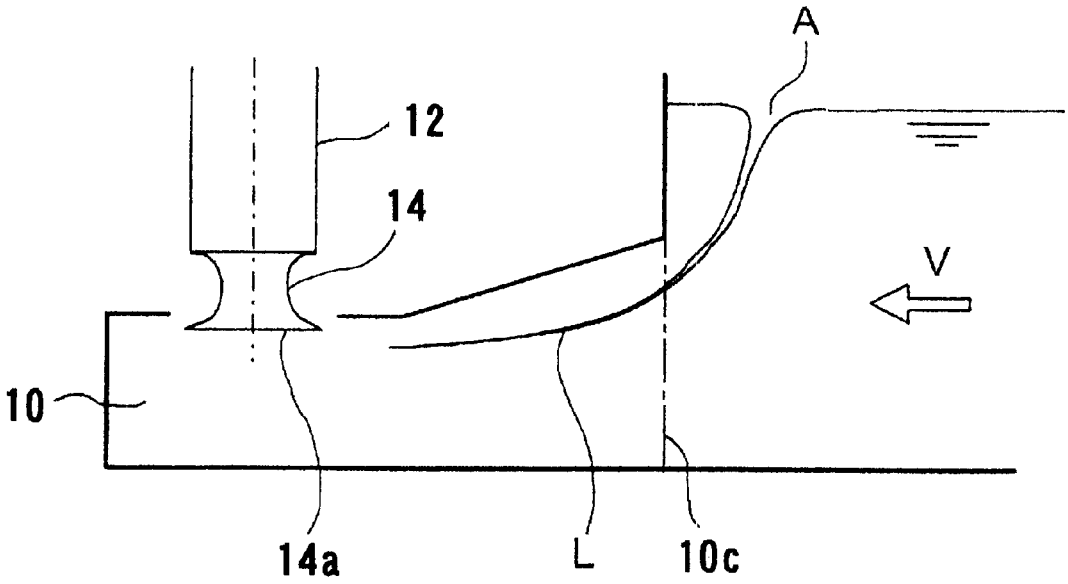
FIG. 32B is a cross-sectional view of the conventional lateral-suction closed channel shown in FIG. 32A.
Figure 33A:
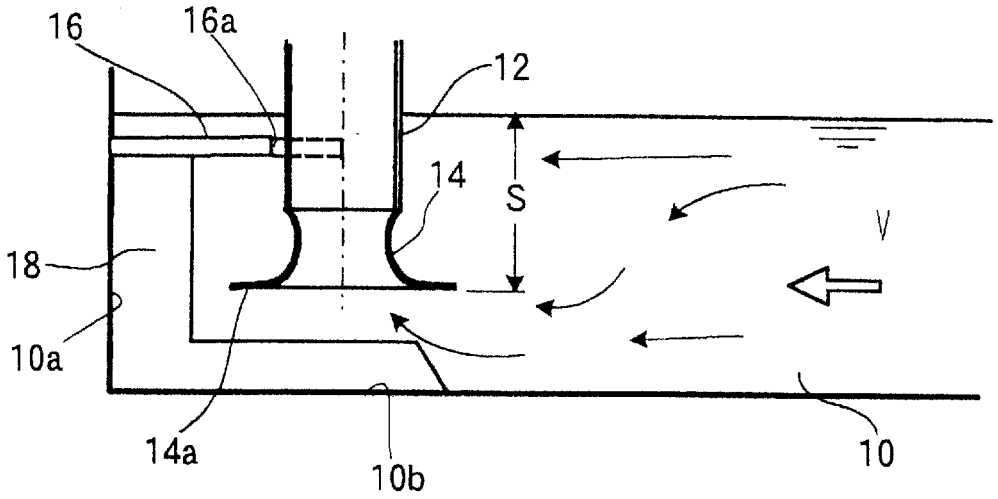
FIG. 33A is a cross-sectional view showing a first conventional vortex prevention structure installed in an open channel.
Figure 33B:
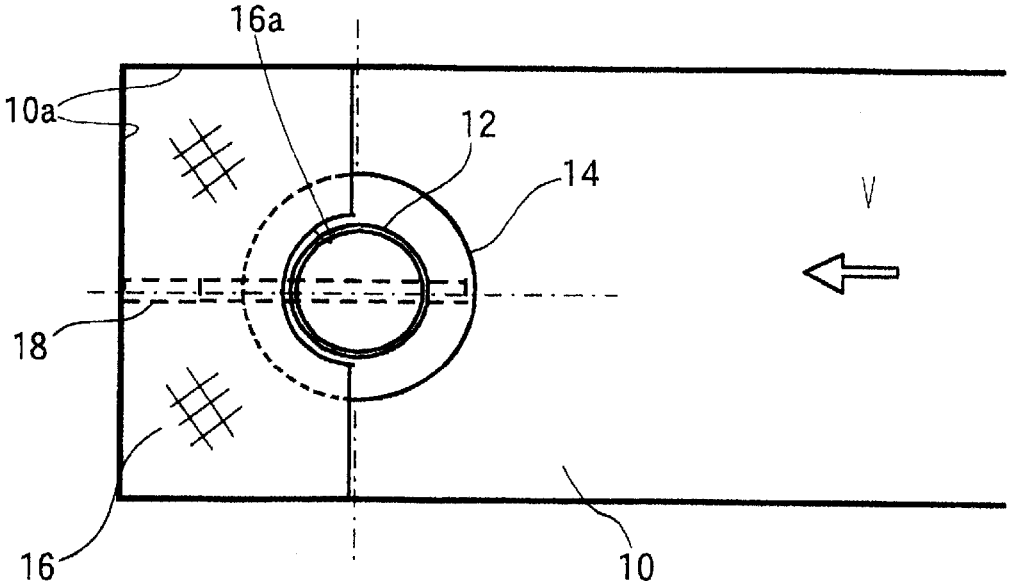
FIG. 33B is a plan view of the first conventional vortex prevention structure shown in FIG. 33A.
Figure 34A:
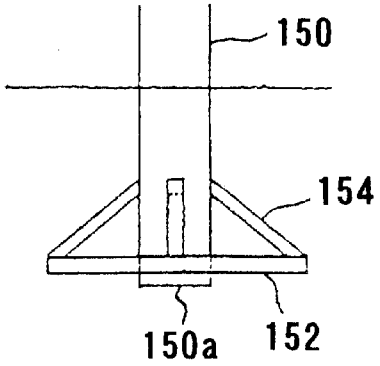
FIG. 34A is a side elevational view showing a second conventional vortex prevention structure installed in an open channel.
Figure 34B:
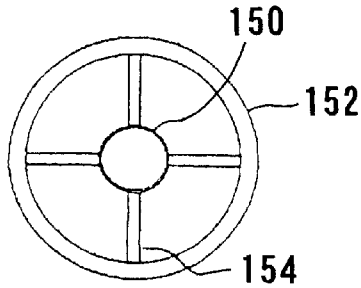
FIG. 34B is a plan view of the second conventional vortex prevention structure shown in FIG. 34A.
Figure 35:
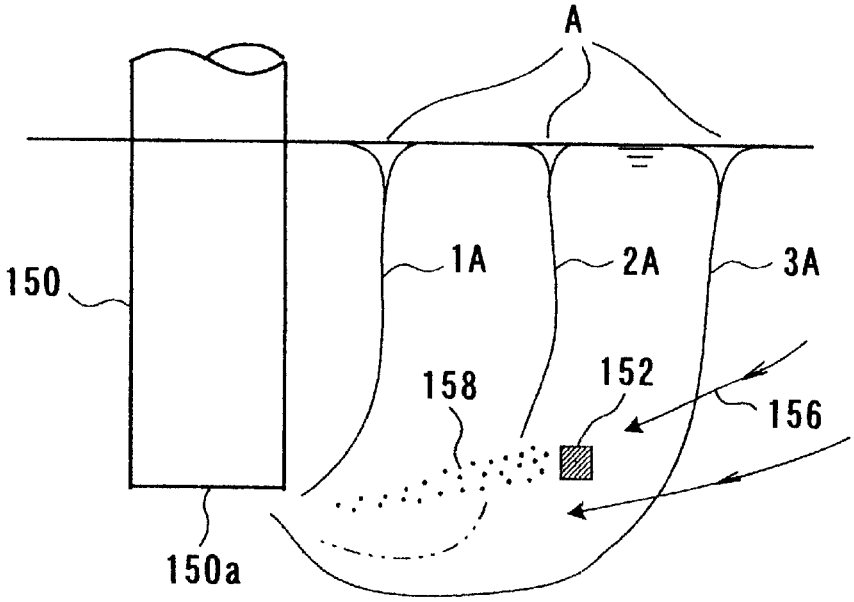
FIG. 35 is a view illustrative of the manner in which the second conventional vortex prevention structure operates.
Figure 36A:
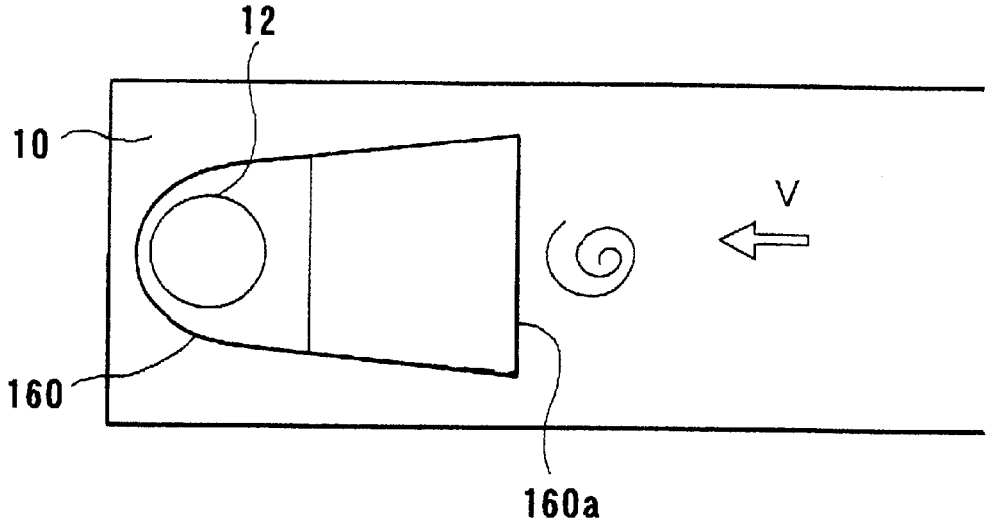
FIG. 36A is a plan view of a third conventional vortex prevention structure.
Figure 36B:
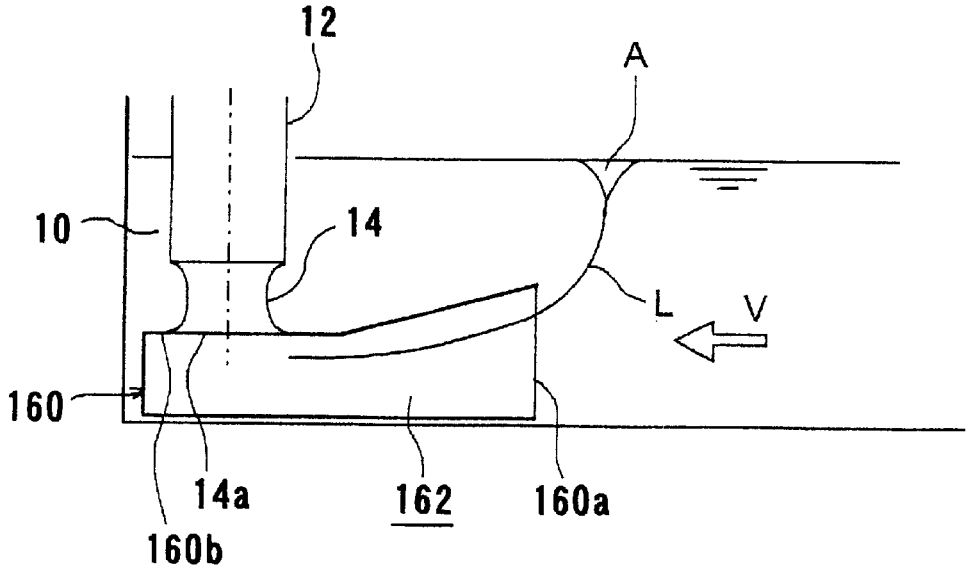
FIG. 36B is a cross-sectional view of the third conventional vortex prevention structure.

The vortex prevention apparatus according to the eleventh embodiment may be combined with the conventional structures. For example, the vortex prevention apparatus may be combined with the conventional structure shown in FIGS. 31A and 31B by pre-assembling the inflow water channel casing 160, the flow-rectifying plate 222, and the vertical plates 224, 226 in the factory and then connecting the connection port 160*b* of the inflow water channel casing 160 to the suction port 14*a* of the suction bell mouth 14. The vortex prevention apparatus may be combined with the conventional structure shown in FIGS. 36A and 36B by pre-assembling the flow-rectifying plate 222 and the vertical plates 224, 226 in the factory and then fixing the vertical plates 224, 226 to the top plate 220 of the inflow water channel casing 160. With these combined structures, it is not necessary to install a vortex prevention structure in the pump pit 10 and the overall installation work is simple.

A water flow $B_1$ indicated by the dotted line in FIG. 24B may possibly occur from a portion behind the flow-rectifying plate 222 when the water level is high or the swirling flows $R_1$, $R_2$ are intense.

Figure 25A:
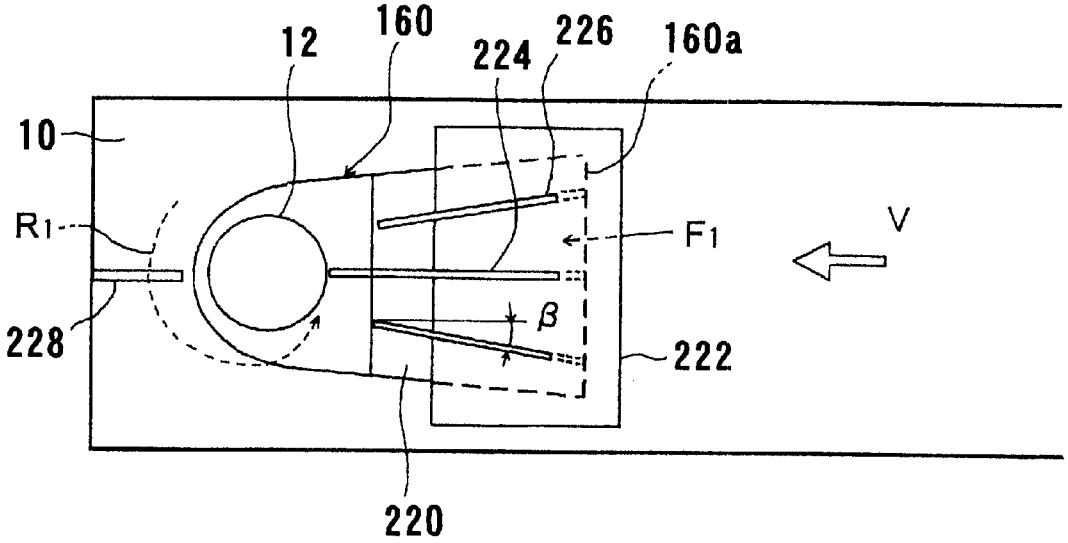
FIG. 25A is a plan view of a vortex prevention apparatus according to a twelfth embodiment of the present invention.
Figure 25B:
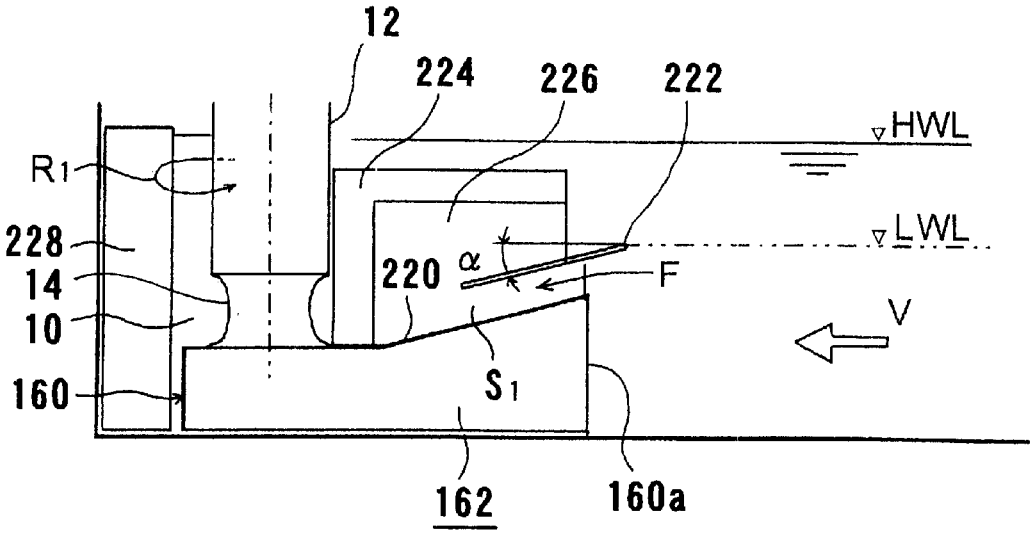
FIG. 25B is a cross-sectional view of the vortex prevention apparatus shown in FIG. 25A.

FIGS. 25A and 25B show a vortex prevention apparatus according to a twelfth embodiment of the present invention. As shown in FIGS. 25A and 25B, the vortex prevention apparatus has a flow-rectifying plate 222 inclined at an angle $\alpha$ to a horizontal plane along the water flow such that the flow-rectifying plate 222 is tilted downwardly, and auxiliary vertical plates 226 inclined at an angle $\beta$ to a vertical plane along the water flow such that the distance between the auxiliary vertical plates 226 is progressively reduced along the water flow. The angle a between the flow-rectifying plate 222 and the horizontal plane is preferably in the range of ±30°, and the angle $\beta$ between the auxiliary vertical plate 226 and the vertical plane is also preferably in the range of ±30°.

The flow-rectifying plate 222 and the auxiliary vertical plates 226 thus inclined adjust the water flow $F_1$ through the gap $S_1$ between the top plate 220 and the flow-rectifying plate 222 for an increased vortex prevention capability.

In this embodiment, a vertically extending swirling flow prevention plate 228 is disposed between the rear end of the inflow water channel casing 160 and the rear wall of the pump pit 10. The vertically extending swirling flow prevention plate 228 is effective to make it difficult for a swirling flow $R_1$ to be produce around the suction casing 12, even if the gap between the rear end of the inflow water channel casing 160 and the rear wall of the pump pit 10 is large.

Figure 26A:
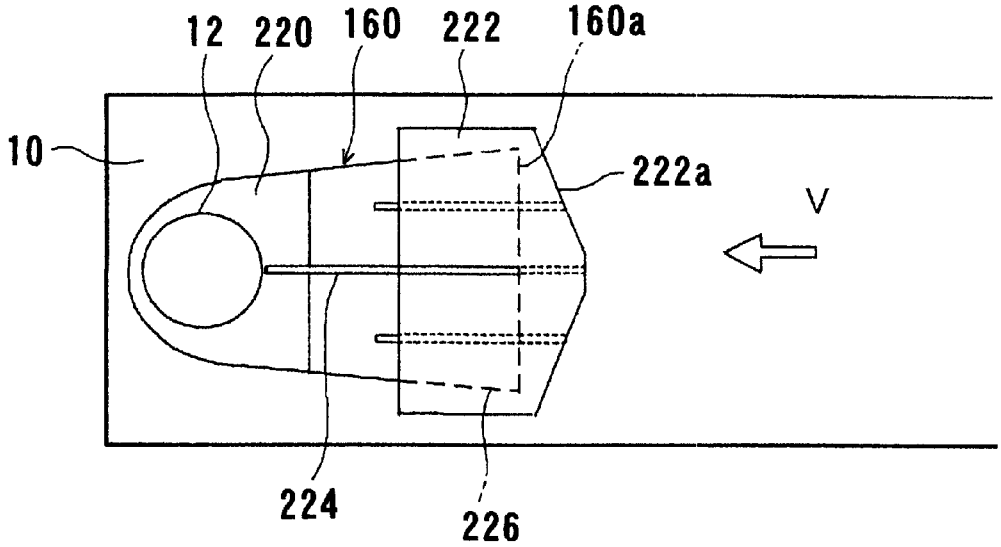
FIG. 26A is a plan view of a vortex prevention apparatus according to a thirteenth embodiment of the present invention.
Figure 26B:
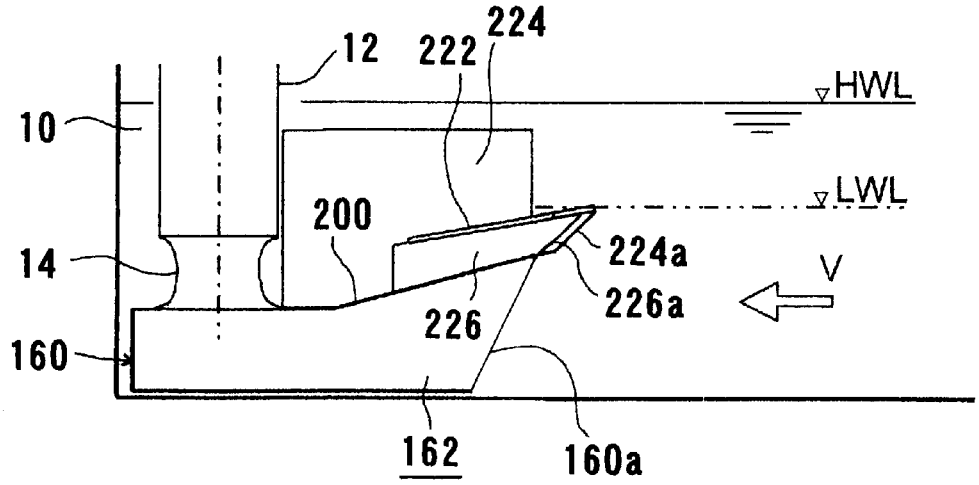
FIG. 26B is a cross-sectional view of the vortex prevention apparatus shown in FIG. 26A.

FIGS. 26A and 26B show a vortex prevention apparatus according to a thirteenth embodiment of the present invention. As shown in FIGS. 26A and 26B, the vortex prevention apparatus is arranged to prevent foreign matter from being attached to the flow-rectifying plate 222 and the vertical plates 224, 226. Specifically, the flow-rectifying plate 222 has a front edge 222*a* progressively inclined along the water flow toward the opposite ends thereof, and the main and auxiliary vertical plates 224, 226 have respective front edges 224*a*, 226*a* positioned below the flow-rectifying plate 222 and progressively inclined downwardly along the water flow. Therefore, any foreign matter attached to these inclined front edges 222*a*, 224*a*, 226*a* can easily be removed. The auxiliary vertical plates 226 do not project upwardly beyond the flow-rectifying plate 222.

Figure 27A:
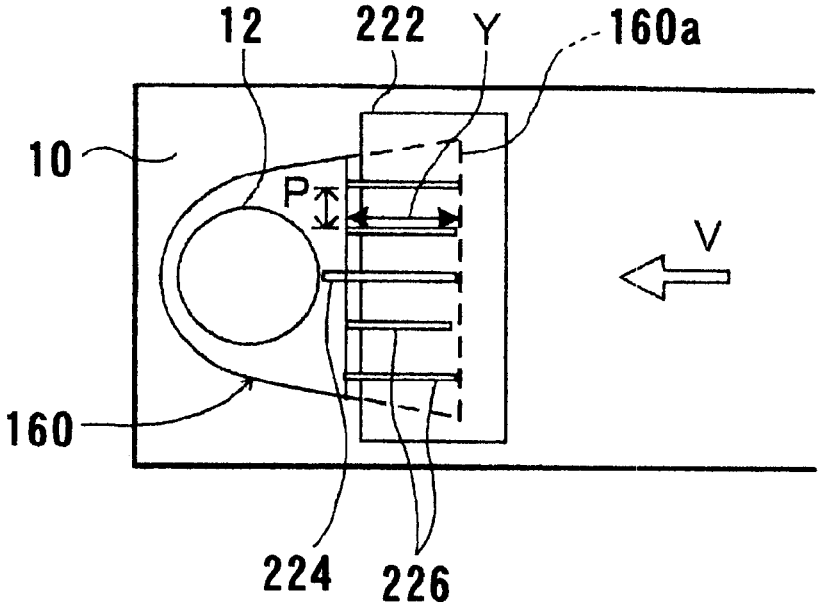
FIG. 27A is a plan view of a vortex prevention apparatus according to a fourteenth embodiment of the present invention.
Figure 27B:
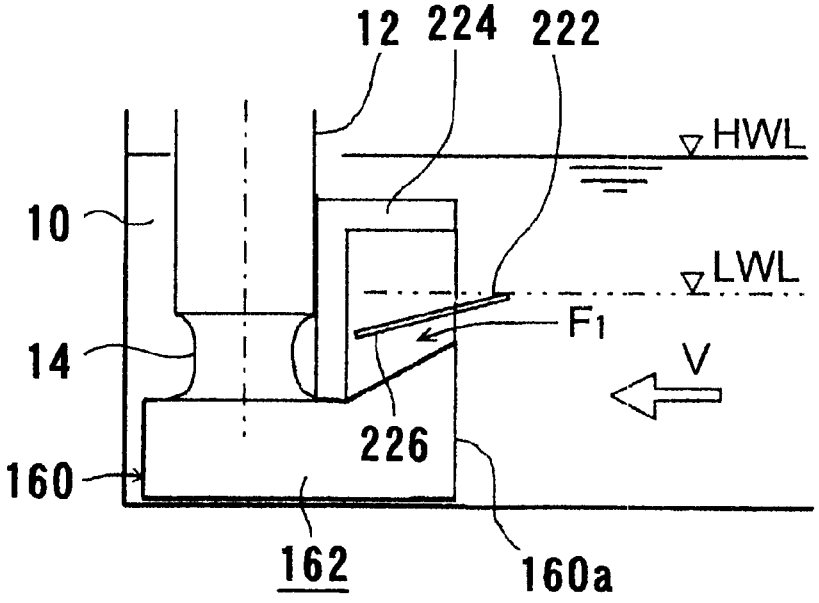
FIG. 27B is a cross-sectional view of the vortex prevention apparatus shown in FIG. 27A.

FIGS. 27A and 27B show a vortex prevention apparatus according to a fourteenth embodiment of the present invention. As shown in FIGS. 27A and 27B, the vortex prevention apparatus is made compact by reducing the length of the inflow water channel casing 160 along the water flow. Specifically, two pairs of, i.e., four, auxiliary vertical plates 226, which are transversely spaced at a given pitch P, are disposed two on each side of the main vertical plate 224. It has experimentally been confirmed that the four auxiliary vertical plates 226 provide a greater vortex prevention capability than the two auxiliary vertical plates 226. The number of auxiliary vertical plates 226 may be represented by Y/P=about 2 or 3, where Y indicates the length of the auxiliary vertical plates 226 along the water flow, and P the pitch at which the auxiliary vertical plates 226 are transversely spaced.

Figure 28A:
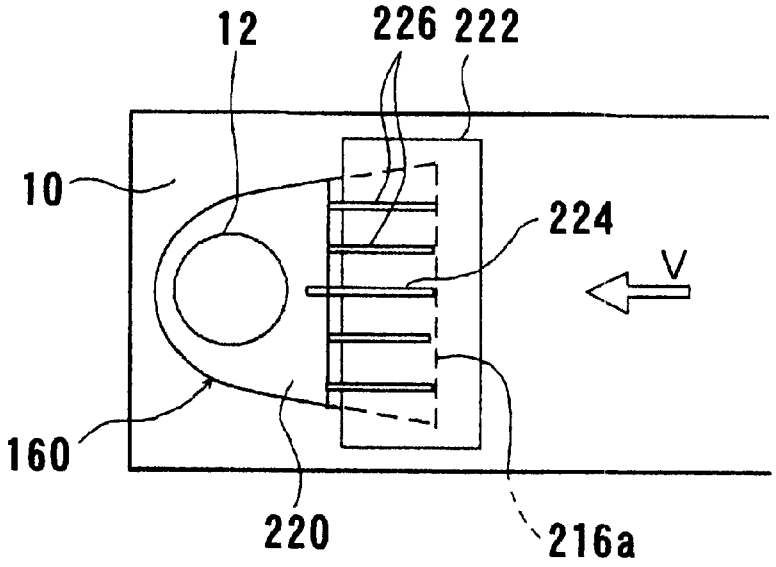
FIG. 28A is a plan view of a vortex prevention apparatus according to a fifteenth embodiment of the present invention.
Figure 28B:
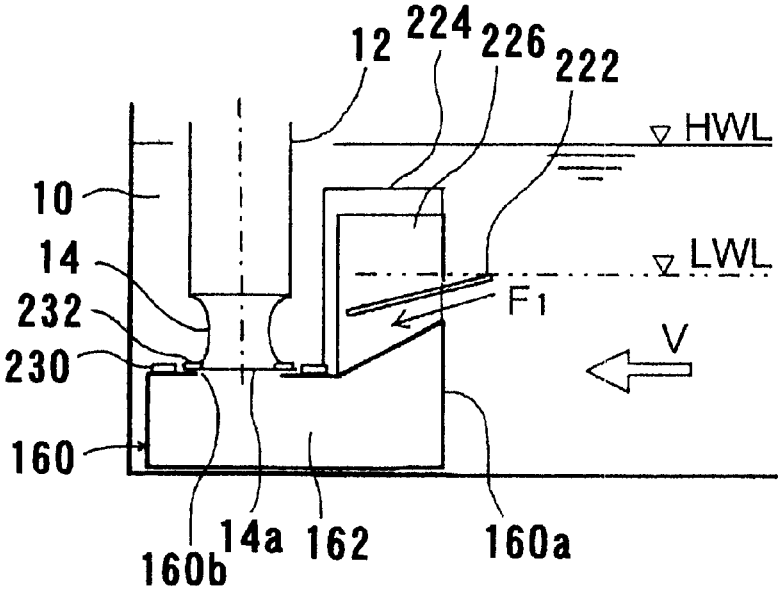
FIG. 28B is a cross-sectional view of the vortex prevention apparatus shown in FIG. 28A.

FIGS. 28A and 28B show a vortex prevention apparatus according to a fifteenth embodiment of the present invention. As shown in FIGS. 28A and 28B, the vortex prevention apparatus has a fitting ring 230 disposed around the connection port 160*b* of the inflow water channel casing 160, and a flange 232 disposed around the outer peripheral edge of the suction port 14*a* of the suction bell mouth 14. The flange 232 is fitted in the fitting ring 230, thereby integrally combining the inflow water channel casing 160 and the suction casing 12 with each other. By installing the inflow water channel casing 160 in the pump pit 10, suspending the suction casing 12, and fitting the flange 232 in the fitting ring 230, the inflow water channel casing 160 and the suction casing 12 can integrally be combined with each other, thus facilitating maintenance of the suction casing 12. Other details of the vortex prevention apparatus according to the fifteenth embodiment are identical to those of the vortex prevention apparatus according to the fourteenth embodiment shown in FIGS. 27A and 27B.

Figure 29A:
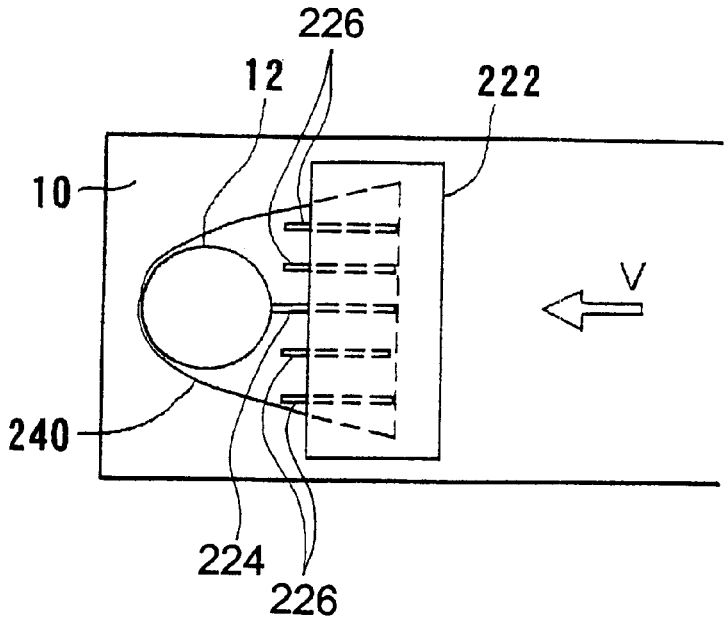
FIG. 29A is a plan view of a vortex prevention apparatus according to a sixteenth embodiment of the present invention.
Figure 29B:
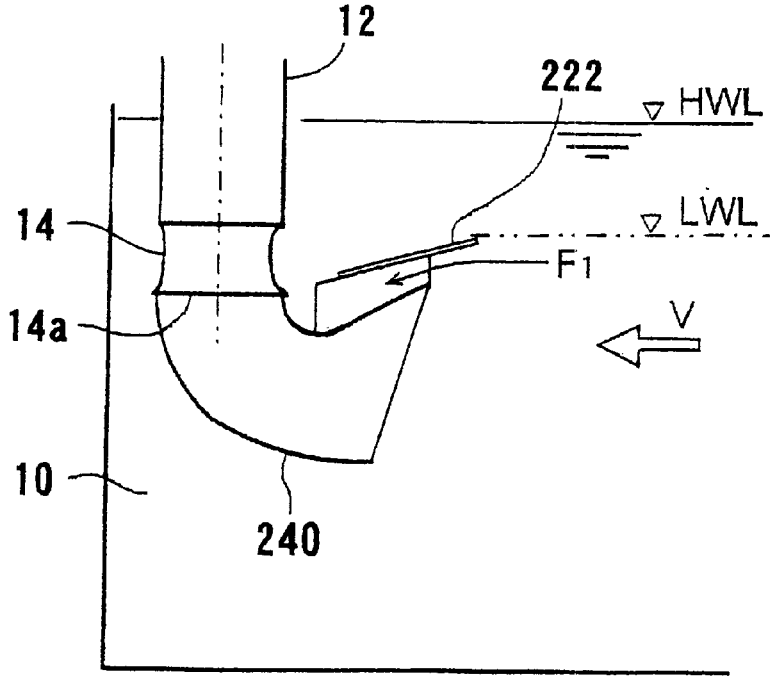
FIG. 29B is a cross-sectional view of the vortex prevention apparatus shown in FIG. 29A.

FIGS. 29A and 29B show a vortex prevention apparatus according to a sixteenth embodiment of the present invention. As shown in FIGS. 29A and 29B, the pump vortex prevention apparatus is made compact and lightweight by integrally combining an elbow-type suction casing (inflow water channel structure) 240 constituting a suction member with the suction bell mouth 14, and arranging an assembly of a flow-rectifying plate 222 which is essentially the same as that shown in FIGS. 27A and 27B, above the elbow-type suction casing 240. In this case, only upper portions of the vertical plates 224, 226 which project upwardly from the flow-rectifying plate 222 are eliminated.

According to the sixteenth embodiment, since the pump may be operated with the suction casings 12, 240 being suspended underwater, components of the pump are not required to be installed on the bottom of the pump pit 10, and no vortex prevention structure is required to be installed in the pump pit 10.

Figure 30A:
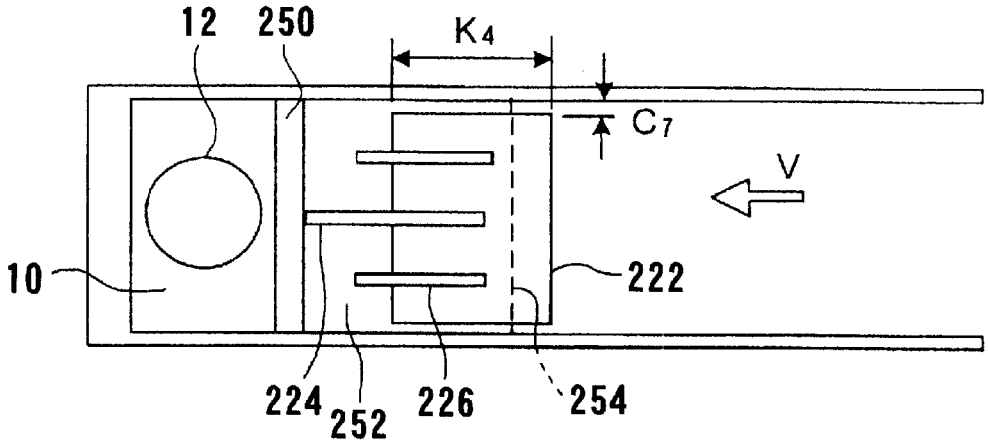
FIG. 30A is a plan view of a vortex prevention apparatus according to a seventeenth embodiment of the present invention.
Figure 30B:
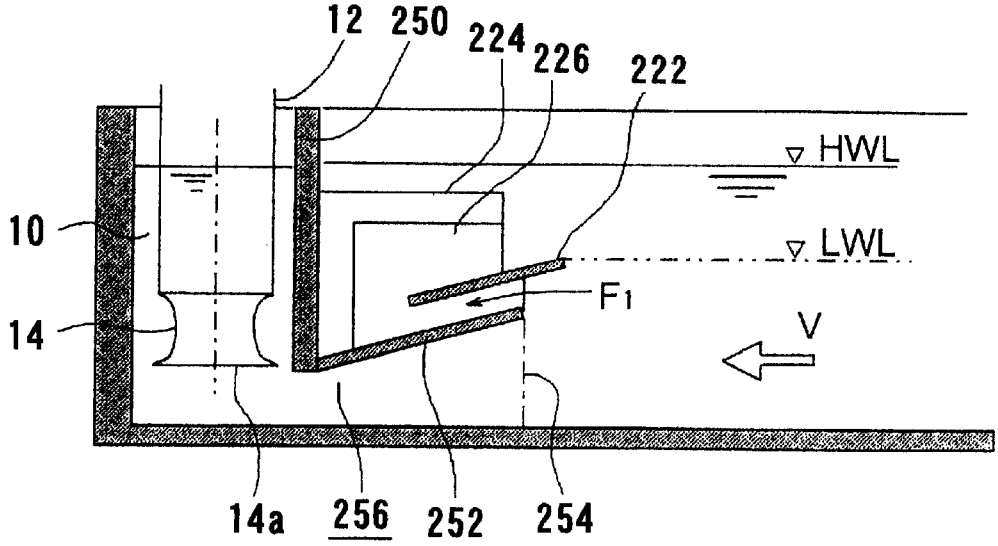
FIG. 30B is a cross-sectional view of the vortex prevention apparatus shown in FIG. 30A.

FIGS. 30A and 30B show a vortex prevention apparatus according to a seventeenth embodiment of the present invention. As shown in FIGS. 30A and 30B, the suction casing 12 is disposed in the pump pit 10 that is divided by a vertical partition wall 250. A horizontal partition wall (inflow water channel structure) 252 which extends substantially horizontally to an upstream side is joined to the lower end of the vertical partition wall 250. The horizontal partition wall 252 has a front end defining an inlet port 254 therein, and defines a water flow path 256 between the horizontal partition wall 252 and surrounding walls of the water channel. An assembly of a flow-rectifying plate 222 and vertical plates 224, 226, which are essentially the same as those shown in FIGS. 24A and 24B, is disposed above the horizontal partition wall 252. The partition walls 250, 252 are made of concrete, for example.

In this embodiment, the flow-rectifying plate 222 and the vertical plates 224, 226 may be made of concrete rather than steel sheet. Although the flow-rectifying plate 222 may be directly joined to the side walls of the water channel, the flow-rectifying plate 222 should preferably be spaced from the side walls of the water channel by a gap $C_7$. This gap $C_7$ is preferably in the range of 0.1 to 0.2 of the length $K_4$ of the flow-rectifying plate 222.

In the embodiments shown in FIGS. 24 through 30, shear flows having different velocities across the flow-rectifying plate are produced, and a water flow flowing between the flow-rectifying plate and the inflow water channel structure cuts off a vortex filament interconnecting the free water surface where an air entrained vortex is formed and the inlet port. Therefore, even if the velocity of the water flow in the water channel increases, an air entrained vortex is prevented from being produced in the pump pit. Further, the pump vortex prevention apparatuses according to the eleventh through seventeenth embodiments are relatively simple in structure and can be installed with ease.

In the embodiments, as a suction member, although a bell mouth or an inflow water channel casing is shown, such suction member includes a straight pipe, or the like.

Although certain preferred embodiments of the present invention have been shown and described in detail, it should be understood that various changes and modifications may be made therein without departing from the scope of the appended claims.

What is claimed is:

1. A vortex prevention apparatus comprising:

a suction member disposed in an open water channel and comprising a suction port; and an auxiliary flow-path forming structure disposed substantially concentrically around said suction member with a gap defined between said auxiliary flow-path forming structure and an outer circumferential surface of said suction member, said auxiliary flow-path forming structure defining an auxiliary flow path, said auxiliary flow path forming structure includes means for guiding flow through an auxiliary flow path;

wherein said auxiliary flow-path forming structure is mounted on said suction member and disposed substantially horizontally over said suction port and in surrounding relation to an entire circumferential surface of said suction member.

2. A vortex prevention apparatus according to claim 1, wherein said auxiliary flow-path forming structure is disposed substantially horizontally over said suction port and spaced therefrom by a predetermined distance.

3. A vortex prevention apparatus according to claim 2, wherein said auxiliary flow-path forming structure comprises an auxiliary flow-path forming plate, said flow-path forming plate comprising said means for guiding.

4. A vortex prevention apparatus according to claim 1, wherein said auxiliary flow-path forming structure comprises at least one ring-shaped pipe, said ring-shaped pipe comprising said means for guiding.

5. A vortex prevention apparatus according to claim 1, wherein said auxiliary flow-path forming structure is of a substantially cylindrical shape disposed around said suction member and spaced therefrom by a predetermined distance.

6. A vortex prevention apparatus according to claim 5, wherein said auxiliary flow-path forming structure is mounted on said suction member by a plurality of ribs disposed at spaced intervals in a circumferential direction of said auxiliary flow-path forming structure, said ribs comprising said means for guiding.

7. A vortex prevention apparatus according to claim 5, wherein said auxiliary flow-path forming structure comprises a plurality of divided members disposed in surrounding relation to a substantially entire circumferential surface of said suction member or a given position of said suction member, said divided members comprising said means for guiding.

8. The vortex prevention apparatus according to claim 5, further comprising a disk-shaped auxiliary top plate comprising a hole and disposed above said auxiliary flow-path forming structure with a gap defined between said disk-shaped auxiliary top plate and said auxiliary flow-path forming structure, said disk-shaped auxiliary top plate comprising said means for guiding.

9. The vortex prevention apparatus according to claim 5, further comprising a bent guide integrally joined to a lower end of said auxiliary flow-path forming structure, said bent guide being curved toward said suction port, said bent guide comprising said means for guiding.

10. The vortex prevention apparatus according to claim 5, further comprising a pump mount base comprising a plurality of vertically extending flow-rectifying ribs, the auxiliary flow-path forming structure being disposed between the vertically extending flow-rectifying ribs, said vertically extending flow-rectifying ribs comprising said means for guiding.

11. The vortex prevention apparatus according to claim 5, further comprising a disk-shaped inflow amount adjusting plate comprising a hole and mounted on an upper end of said auxiliary flow-path forming structure, said adjusting plate comprising said means for guiding.

12. The vortex prevention apparatus according to claim 2, wherein said auxiliary flow-path forming structure is mounted on said suction member by a plurality of ribs disposed at spaced intervals in a circumferential direction of said auxiliary flow-path forming structure, said ribs comprising said means for guiding.

13. The vortex prevention apparatus according to claim 2, further comprising:

a swirling flow prevention plate mounted on at least one of upper and lower surfaces of said auxiliary flow-path forming structure, and extending vertically and linearly along a water flow, said swirling flow prevention plate comprising said means for guiding.

14. A vortex prevention apparatus comprising:

a suction member disposed in an open water channel and comprising a suction port; and an auxiliary flow-path forming structure disposed substantially concentrically around said suction member with a gap defined between said auxiliary flow-path forming structure and an outer circumferential surface of said suction member, said auxiliary flow-path forming structure defining an auxiliary flow path;

wherein said auxiliary flow-path forming structure is disposed substantially horizontally over said suction port and spaced therefrom by a predetermined distance;

wherein said auxiliary flow-path forming structure is mounted on said suction member by a plurality of ribs disposed at spaced intervals in a circumferential direction of said-auxiliary flow-path forming structure.

15. A vortex prevention apparatus comprising:

a suction member disposed in an open water channel and comprising a suction port; and an auxiliary flow-path forming structure disposed substantially concentrically around said suction member with a gap defined between said auxiliary flow-path forming structure and an outer circumferential surface of said suction member, said auxiliary flow-path forming structure defining an auxiliary flow path;

wherein said auxiliary flow-path forming structure comprises a plurality of divided members disposed in surrounding relation to a substantially entire circumferential surface of said suction member or a given position of said suction member.

16. A vortex prevention apparatus comprising:

a suction member disposed in an open water channel and comprising a suction port;

an auxiliary flow-path forming structure disposed substantially concentrically around said suction member with a gap defined between said auxiliary flow-path forming structure and an outer circumferential surface of said suction member, said auxiliary flow-path forming structure defining an auxiliary flow path; and a swirling flow prevention plate mounted on at least one of upper and lower surfaces of said auxiliary flow-path forming structure, and extending vertically and linearly along a water flow;

wherein said auxiliary flow-path forming structure is disposed substantially horizontally over said suction port and spaced therefrom by a predetermined distance.

17. A vortex prevention apparatus comprising:

a suction member disposed in an open water channel and comprising a suction port;

an auxiliary flow-path forming structure disposed substantially concentrically around said suction member with a gap defined between said auxiliary flow-path forming structure and an outer circumferential surface of said suction member, said auxiliary flow-path forming structure defining an auxiliary flow path; and a disk-shaped auxiliary top plate comprising a hole and disposed above said auxiliary flow-path forming structure with a gap defined between said disk-shaped auxiliary top plate and said auxiliary flow-path forming structure;

wherein said auxiliary flow-path forming structure is of a substantially cylindrical shape disposed around said suction member and spaced therefrom by a predetermined distance.

18. A vortex prevention apparatus comprising:

a suction member disposed in an open water channel and comprising a suction port;

an auxiliary flow-path forming structure disposed substantially concentrically around said suction member with a gap defined between said auxiliary flow-path forming structure and an outer circumferential surface of said suction member, said auxiliary flow-path forming structure defining an auxiliary flow path; and a bent guide integrally joined to a lower end of said auxiliary flow-path forming structure, said bent guide being curved toward said suction port;

wherein said auxiliary flow-path forming structure is of a substantially cylindrical shape disposed around said suction member and spaced therefrom by a predetermined distance.

19. A vortex prevention apparatus comprising:

a suction member disposed in an open water channel and comprising a suction port; and an auxiliary flow-path forming structure disposed substantially concentrically around said suction member with a gap defined between said auxiliary flow-path forming structure and an outer circumferential surface of said suction member, said auxiliary flow-path forming structure defining an auxiliary flow path; and a pump mount base comprising a plurality of vertically extending flow-rectifying ribs, the auxiliary flow-path forming structure being disposed between the vertically extending flow-rectifying ribs;

wherein said auxiliary flow-path forming structure is of a substantially cylindrical shape disposed around said suction member and spaced therefrom by a predetermined distance.

20. A vortex prevention apparatus comprising:

a suction member disposed in an open water channel and comprising a suction port;

an auxiliary flow-path forming structure disposed substantially concentrically around said suction member with a gap defined between said auxiliary flow-path forming structure and an outer circumferential surface of said suction member, said auxiliary flow-path forming structure defining an auxiliary flow path; and a disk-shaped inflow amount adjusting plate comprising a hole and mounted on an upper end of said auxiliary flow-path forming structure;

wherein said auxiliary flow-path forming structure is of a substantially cylindrical shape disposed around said suction member and spaced therefrom by a predetermined distance.

21. A vortex prevention apparatus comprising:

a suction member disposed in an open water channel and comprising a suction port;

an auxiliary flow-path forming structure disposed substantially concentrically around said suction member with a gap defined between said auxiliary flow-path forming structure and an outer circumferential surface of said suction member, said auxiliary flow-path forming structure defining an auxiliary flow path; and a suction cone disposed below said suction port.

22. A vortex prevention apparatus comprising:

a suction member disposed in an open water channel and comprising a suction port, said suction member comprising at least one through hole; and an auxiliary flow-path forming structure disposed substantially concentrically around said suction member, said auxiliary flow-path forming structure being fixedly mounted on a free end of said suction member.

23. A vortex prevention apparatus comprising:

an inflow water channel structure defining a closed inflow water channel comprising a laterally open inlet port; and a flow-rectifying plate disposed above said inflow water channel structure and extending upstream of said inlet port in covering relation to said inlet port, said flow-rectifying plate being disposed substantially horizontally and spaced by a predetermined distance from an upper end of said inflow water channel structure.

24. A vortex prevention apparatus according to claim 23, wherein said flow-rectifying plate has a front edge progressively inclined along a water flow toward opposite ends thereof.

25. A vortex prevention apparatus according to claim 23, further comprising:

a plurality of vertical plates disposed between said inflow water channel structure and said flow-rectifying plate and extending vertically along a water flow, at least one of said vertical plates extending above said flow-rectifying plate.

26. A vortex prevention apparatus according to claim 25, wherein said vertical plate is inclined to a vertical plane along said water flow by an angle in the range of ±30°.

27. A vortex prevention apparatus according to claim 25, wherein said vertical plate has a front edge progressively inclined downwardly along said water flow.

28. A vortex prevention apparatus according to claim 23, wherein said inflow water channel structure is detachably connected to a pump suction port.

29. A vortex prevention apparatus according to claim 23, wherein said inflow water channel structure comprises an elbow-type suction casing.

30. A vortex prevention apparatus comprising:

an inflow water channel structure defining a closed inflow water channel comprising a laterally open inlet port; and a flow-rectifying plate disposed above said inflow water channel structure and extending upstream of said inlet port in covering relation to said inlet port;

wherein said flow-rectifying plate is inclined to a horizontal plane by an angle in the range of ±30°;

said flow-rectifying plate being spaced by a predetermined distance from an upper end of said inflow water channel structure.

* * * * *